US008286724B2

(12) United States Patent
Furusawa et al.

(10) Patent No.: US 8,286,724 B2
(45) Date of Patent: Oct. 16, 2012

(54) IMPACT TOOL

(75) Inventors: Masanori Furusawa, Anjo (JP); Yoshihiro Kasuya, Anjo (JP); Hajime Takeuchi, Anjo (JP)

(73) Assignee: Makita Corporation, Anjo-shi (JP)

( * ) Notice: Subject to any disclaimer, the term of this patent is extended or adjusted under 35 U.S.C. 154(b) by 151 days.

(21) Appl. No.: 12/725,029

(22) Filed: Mar. 16, 2010

(65) Prior Publication Data

US 2010/0236801 A1 Sep. 23, 2010

(30) Foreign Application Priority Data

Mar. 23, 2009 (JP) ..... 2009-070700

(51) Int. Cl.
*B25B 21/00* (2006.01)
*E02D 3/068* (2006.01)

(52) U.S. Cl. ..... 173/47; 173/48

(58) Field of Classification Search ..... 173/162.1, 173/162.2, 170, 217, 47, 48
See application file for complete search history.

(56) References Cited

U.S. PATENT DOCUMENTS

| | | | | |
|---|---|---|---|---|
| 3,519,089 | A * | 7/1970 | Schnettler | 173/170 |
| 4,189,080 | A * | 2/1980 | Smith et al. | 227/8 |
| 4,879,438 | A * | 11/1989 | Winchester | 200/61.85 |
| 5,428,197 | A * | 6/1995 | McCurry et al. | 200/332.2 |
| 6,725,944 | B2 * | 4/2004 | Burger et al. | 173/48 |
| 6,913,088 | B2 * | 7/2005 | Berger | 173/48 |
| 7,044,234 | B2 * | 5/2006 | Manschitz et al. | 173/48 |
| 7,322,427 | B2 | 1/2008 | Shimma et al. | |
| 7,523,790 | B2 | 4/2009 | Arakawa et al. | |
| 2003/0037937 | A1 * | 2/2003 | Frauhammer et al. | 173/48 |
| 2006/0011361 | A1 * | 1/2006 | Shimma et al. | 173/48 |

FOREIGN PATENT DOCUMENTS

| | | |
|---|---|---|
| GB | 2314288 | * 12/1997 |
| JP | A-2006-957 | 1/2006 |
| JP | A-2006-272511 | 10/2006 |

OTHER PUBLICATIONS

Search Report issued in European Patent Application No. 10002957.8; mailed Jan. 31, 2012.

* cited by examiner

*Primary Examiner* — Sameh H. Tawfik
*Assistant Examiner* — Nathaniel Chukwurah
(74) *Attorney, Agent, or Firm* — Oliff & Berridge, PLC

(57) ABSTRACT

An impact tool includes a vibration-proofing cushioning material connecting a tool body and a handle. The tool further includes a motor-driving manual operating member disposed on the handle, an operation mode switching member disposed on the tool body, and a movable member. When the switching member is switched to first mode in which the tool bit is continuously driven, the movable member moves the manual operating member from an off position and locks it in an on position. When the switching member is switched to second mode in which the tool bit is arbitrarily driven, the movable member releases the lock of the manual operating member. A vibration-proofing elastic member is disposed in the vibration transmitting path and prevents vibration caused in the tool body from being transmitted to the handle in the state in which the manual operating member is locked in the on position by the movable member.

14 Claims, 13 Drawing Sheets

IMPACT TOOL

BACKGROUND OF THE INVENTION

1. Field of the Invention

The invention relates to an impact tool which is capable of performing a hammering operation on a workpiece by driving a tool bit to perform at least a striking movement.

2. Description of the Related Art

Japanese laid-open patent publication No. 2006-957 discloses a hammer drill in which a movable member is disposed in a region of connection between a tool body and a handle and is interlocked with an operation mode switching member to lock a handle-side trigger in the on position to turn on the electric switch.

On the other hand, Japanese laid-open patent publication No. 2006-272511 discloses an impact tool with a vibration-proof handle connected to a tool body via a cushioning material in order to protect the user against vibration caused in the tool body during operation.

It is desired for the impact tool to cope with above-described both aspects at the same time.

SUMMARY OF THE INVENTION

It is an object of the invention to provide an impact tool that can cope with both the switch selecting function and the handle vibration-proofing function.

Above described object can be achieved by the claimed invention. In a preferred embodiment according to the invention, an impact tool includes a motor, a tool body, a handle, a vibration-proofing cushioning material, a manual operating member, an operation mode switching member and a movable member. The tool body houses the motor, and a tool bit to be driven by the motor is coupled to a tip end region of the tool body. The handle is disposed on a side of the tool body opposite from the tip end region to which the tool bit is coupled.

The vibration-proofing cushioning material is disposed between the tool body and the handle and connects the tool body and the handle such that the tool body and the handle can move with respect to each other in an axial direction of the tool bit. The "vibration-proofing cushioning material" in this invention typically represents a spring, but suitably includes a rubber. The manual operating member is disposed on the handle, biased from an on position in which current is passed to the motor to an off position in which said passage of current is interrupted, and normally placed in the off position and can be operated by user's finger between the off position and the on position. The manner of "operating" the manual operating member suitably includes the manner of moving it linearly via a guide member as necessary, the manner of moving it in a curve, and the manner of turning it around a pivot.

The operation mode switching member is disposed on the tool body and can switch between first operation mode in which the tool bit is continuously driven and second operation mode in which the tool bit is arbitrarily driven. The "first operation mode" in this invention represents an operation mode of performing a hammering operation only by striking movement of the tool bit by continuously driving the motor without keeping the manual operating member in the on position by user's finger. The "second operation mode" in this invention represents an operation mode of performing a hammer drill operation by striking movement and rotation of the tool bit, a hammering operation only by striking movement and a drilling operation only by rotation, by operating the manual operating member between the on position and the off position to arbitrarily (intermittently) drive the motor. Further, the manner of "switching the operation mode" in this invention suitably includes both the manner of turning the operation mode switching member around a predetermined axis, and the manner of linearly sliding it in the axial direction of the tool bit. The movable member is moved in the axial direction of the tool bit by the switching operation of the operation mode switching member. When the operation mode switching member is switched to the first operation mode, the movable member moves toward the handle and moves the manual operating member from the off position to the on position and locks it in the on position. When the operation mode switching member is switched to the second operation mode, the movable member moves away from the handle and releases the lock of the manual operating member so that the manual operating member can be returned to the off position and allowed to be operated by user's finger.

According to the invention, in order to prevent vibration caused in the tool body from being transmitted to the handle via a vibration transmitting path which includes at least the movable member and the manual operating member, in the state in which the operation mode switching member is switched to the first operation mode and the manual operating member is locked in the on position by the movable member, a vibration-proofing elastic member is disposed in a predetermined region in the vibration transmitting path.

According to the invention constructed as described above, when the first operation mode is selected with the operation mode switching member, the manual operating member is locked in the on position by the movable member. In this state, the motor and the tool bit can be continuously driven to perform, for example, hammering operation. When the second operation mode is selected, the motor and the tool bit can be intermittently or arbitrarily driven to perform, for example, hammer drill operation, hammering operation or drilling operation, by appropriately operating the manual operating member by user's finger to turn on and off.

Particularly, according to this invention, when the tool bit is driven to perform a predetermined operation, transmission of vibration from the tool body to the handle can be prevented or reduced by the vibration-proofing cushioning member. In this case, when the impact tool is driven in first operation mode in which the manual operating member is held locked in the on position by the movable member, vibration caused in the tool body is transmitted to the handle via the vibration transmitting path which includes at least the movable member and the manual operating member. According to this invention, however, with the construction in which the elastic member is disposed in a predetermined region in the vibration transmitting path, even if vibration is caused in the tool body in the state in which the manual operating member is locked in the on position by the movable member, transmission of the vibration to the handle can be prevented or reduced by the cushioning member.

Specifically, according to the invention, both the switch selecting function of switching between the mode in which the manual operating member is locked in the on position and the mode in which it is arbitrarily operated by finger, and the handle vibration proofing function obtained by connecting the handle to the tool body by the vibration-proofing cushioning member can be realized.

As one aspect according to the invention, the elastic member is provided as one element for forming the manual operating member. The manner of being "provided as one element" represents the manner in which, for example, the manual operating member is formed by a plurality of components and the components are connected to each other via the elastic member.

According to this aspect, in first operation mode in which the manual operating member is locked in the on position by the movable member, transmission of vibration from the tool body to the handle can be prevented or reduced by the elastic member which is incorporated in the manual operating member itself.

As one aspect according to the invention, the manual operating member includes an operating member body which can be operated by user, a lever which is mounted to the operating member body in such a manner as to be rotatable with respect to the operating member body in the axial direction of the tool bit, and a compression spring which biases the lever such that the lever can rotate toward the tool bit. When the operation mode switching member is switched to the first operation mode, in the manual operating member, the lever is pushed toward the handle by the movable member so that the operating member body is moved to the on position via the compression spring and locked in the on position.

According to this aspect with the above-described construction, a vibration proofing structure for the manual operating member can be rationally provided on the manual operating member side.

As one aspect according to the invention, the impact tool further includes a biasing member that biases the operating member body toward the off position. Further, a mounting load of the compression spring is configured to be larger than a load which is applied to the biasing member upon completion of movement of the operating member body into the on position. The "mounting load" in this invention represents an initial load which is applied to the compression spring in order to cause a predetermined deformation in the compression spring when mounting the compression spring.

According to this aspect, in first operation mode, the movable member can reliably move the operating member body into the on position and lock it, and in this locked state, a vibration proofing effect of the compression spring can be exerted.

As one aspect according to the invention, the impact tool further includes a second manual operating member that starts and stops the motor by moving between the on position and the off position. When the operation mode switching member is switched to the second operation mode, the second manual operating member is moved from the off position to the on position by the movable member and locked in the on position, while, when the operation mode switching member is switched to the first operation mode, the lock by the movable member is released so that the second manual operating member is allowed to be operated by user's finger. The manner of "operating" the second manual operating member may suitably include the manner of moving it linearly via a guide member as necessary, the manner of moving it in a curve, and the manner of turning it around a pivot.

According to this aspect, when the first operation mode is selected with the operation mode switching member, the manual operating member is locked in the on position by the movable member, and the second manual operating member is allowed to be operated by user's finger. In this case, by operating the second manual operating member by the finger, the user is allowed to continuously drive the tool bit to perform hammering operation. When the second operation mode is selected, the second manual operating member is locked in the on position by the movable member, and the manual operating member is allowed to be operated by user's finger. In this case, by operating the manual operating member by the finger, the user is allowed to intermittently drive the tool bit to perform, for example, hammer drill operation, hammering operation or drilling operation.

Preferably, it is constructed such that the second manual operating member is housed in a housing space within the tool body when the second manual operating member is moved to the on position by the movable member and locked in the on position. With such a construction, by visually checking whether the second manual operating member is housed in the housing space or not, the user can distinguish whether the currently selected operation mode is the first operation mode or the second operation mode.

As one aspect according to the invention, a second elastic member which is different from said elastic member elastically connects the second manual operating member and the movable member in the state in which the second manual operating member is locked in the on position by the movable member.

According to this aspect, a difference is created between the amount of travel of the movable member which is moved in the axial direction of the tool bit by the operation of switching the operation mode switching member and the amount of travel of the second manual operating member which is actuated by the movable member, and this difference of travel can be accommodated by the second elastic member. In other words, by provision of the second elastic member, the amount of travel of the movable member and the amount of travel of the second manual operating member can be arbitrarily set, so that higher freedom of design is obtained.

As one aspect according to the invention, the operation mode switching member is designed to be operated by turning around an axis extending in a direction transverse to the axial direction of the tool bit, and the operation mode switching member has an eccentric shaft which is disposed in a position displaced a predetermined distance from said axis and revolves around the axis in engagement with the movable member so as to move the movable member in the axial direction of the tool bit. Further, in an engagement region of the movable member which is engaged with the eccentric shaft, a cam face is formed in order to create a difference between the amount of travel of the movable member which corresponds to an angle of rotation of the operation mode switching member and the amount of travel of a component of motion of the eccentric shaft in the axial direction of the tool bit when the operation mode switching member is switched to the first operation mode.

According to this aspect with such a construction, the amount of travel of the movable member can be freely set by adjusting the configuration of the cam face.

As one aspect according to the invention, the vibration-proofing cushioning materials are disposed on opposite sides of the axis of the tool bit along this axis and the movable member is disposed between the cushioning materials. By such arrangement of the vibration-proofing cushioning materials on the opposite sides of the axis of the tool bit, during operation in which the user presses the tool bit against the workpiece while applying a pressing force to the impact tool in the axial direction of the tool bit, stability of the pressing can be provided. Further, by the arrangement of the movable member between the cushioning materials, a rationally arranged structure can be obtained.

Further, in a different aspect according to the invention, an impact tool includes a motor, a tool body, a handle, a vibration-proofing cushioning material, a manual operating member, an operation mode switching member and a movable member. The tool body houses the motor, and a tool bit to be driven by the motor is coupled to a tip end region of the tool body. The handle is disposed on a side of the tool body opposite from the tip end region to which the tool bit is coupled. The vibration-proofing cushioning material is disposed between the tool body and the handle and connects the tool body and the handle such that the tool body and the handle can move with respect to each other in an axial direction of the tool bit. The "vibration-proofing cushioning material" in this invention typically represents a spring, but suitably includes a rubber. The manual operating member is disposed on the handle, biased from an on position in which current is passed to the motor to an off position in which said passage of current is interrupted, and normally placed in the off position and can be operated by user's finger between the off position and the on position. The manner of "operating" the manual operating member suitably includes the manner of moving it linearly via a guide member as necessary, the manner of moving it in a curve, and the manner of turning it around a pivot.

The operation mode switching member is disposed on the tool body and can switch between first operation mode in which the tool bit is continuously driven and second operation mode in which the tool bit is arbitrarily driven. The "first operation mode" in this invention represents an operation mode of performing a hammering operation only by striking movement of the tool bit by continuously driving the motor without keeping the manual operating member in the on position by user's finger. The "second operation mode" in this invention represents an operation mode of performing a hammer drill operation by striking movement and rotation of the tool bit, a hammering operation only by striking movement and a drilling operation only by rotation, by operating the manual operating member between the on position and the off position to arbitrarily (intermittently) drive the motor. Further, the manner of "switching the operation mode" in this invention suitably includes both the manner of turning the operation mode switching member around a predetermined axis, and the manner of linearly sliding it in the axial direction of the tool bit. The movable member is moved in the axial direction of the tool bit by the switching operation of the operation mode switching member. When the operation mode switching member is switched to the first operation mode, the movable member moves toward the handle and moves the manual operating member from the off position to the on position and locks it in the on position. When the operation mode switching member is switched to the second operation mode, the movable member moves away from the handle and releases the lock of the manual operating member so that the manual operating member can be returned to the off position and allowed to be operated by user's finger.

In the different aspect according to this invention, a vibration-proofing spring load of the handle differs according to whether the operation mode switching member is switched to the first operation mode or the second operation mode. The "spring load" in this invention represents a load which is applied to the cushioning spring member between the tool body and the handle during operation in which the user presses the tool bit against the workpiece while applying a pressing force to the impact tool in the axial direction of the tool bit, or a pressing force of pressing the impact tool against the workpiece while holding the handle. In this invention, by provision of a construction in which the manual operating member and the movable member are connected via the vibration-proofing elastic member when the operation mode switching member is switched to the first operation mode and the manual operating member is locked in the on position by the movable member, the difference in the vibration-proofing spring load can be created according to the operation mode.

Other objects, features and advantages of the present invention will be readily understood after reading the following detailed description together with the accompanying drawings and the claims.

DETAILED DESCRIPTION OF THE REPRESENTATIVE EMBODIMENT OF THE INVENTION

Each of the additional features and method steps disclosed above and below may be utilized separately or in conjunction with other features and method steps to provide and manufacture improved impact tools, method for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
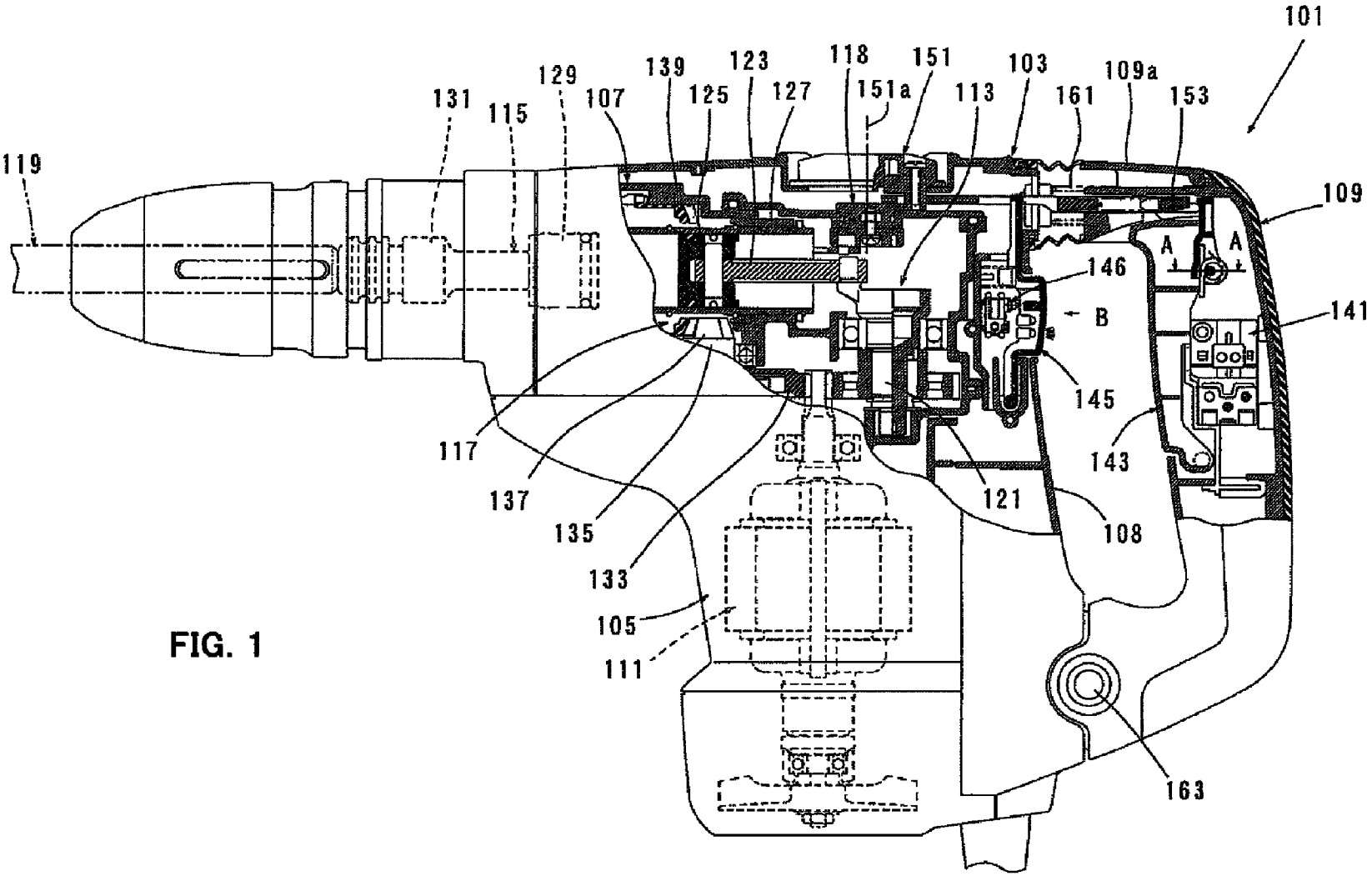
FIG. 1 is a cutaway side view showing an entire electric hammer drill according to an embodiment of the invention.

An embodiment of the invention is now described with reference to FIGS. 1 to 14. FIG. 1 shows an entire electric hammer drill 101 as a representative example of an impact tool according to the invention. As shown in FIG. 1, the hammer drill 101 of this embodiment includes a body 103 that forms an outer shell of the hammer drill 101, an elongate hammer bit 119 detachably coupled to a tool holder (not shown) in a tip end region, on the left side as viewed in FIG. 1, of the body 103 in the longitudinal direction, and a handgrip 109 that is connected to the other end (right end as viewed in FIG. 1) of the body 103 in the longitudinal direction and designed to be held by a user. The body 103, the hammer bit 119 and the handgrip 109 are features that correspond to the "tool body", the "tool bit" and the "handle (to be held by a user)", respectively, according to the invention. The hammer bit 119 is mounted to a tool bit mounting part in the form of the tool holder such that it is allowed to reciprocate with respect to the tool holder in its axial direction (the longitudinal direction of the body 103) and prevented from rotating with respect to the tool holder in its circumferential direction. For the sake of convenience of explanation, the side of a hammer bit 119 is taken as the front and the side of the handgrip 109 as the rear.

The body 103 includes a motor housing 105 that houses a driving motor 111, and a gear housing 107 that houses a motion converting mechanism 113, a striking mechanism 115 and a power transmitting mechanism 117. The driving motor 111 is a feature that corresponds to the "motor" according to this invention. The driving motor 111 is disposed such that its rotating shaft extends in a direction (vertical direction as viewed in FIG. 1) substantially perpendicular to the longitudinal direction of the body 103 (the axial direction of the hammer bit). The rotating output of the driving motor 111 is appropriately converted to linear motion by the motion converting mechanism 113 and then transmitted to the striking mechanism 115. As a result, an impact force is generated in the axial direction of the hammer bit 119 via the striking mechanism 115. Further, the speed of the rotating output of the driving motor 111 is appropriately reduced by the power transmitting mechanism 117 and then transmitted to the hammer bit 119. As a result, the hammer bit 119 is caused to rotate in the circumferential direction.

The handgrip 109 is designed as a handle to be held by a user and disposed on the side of the body 103 opposite from the tool holder in the axial direction of the hammer bit 119. The handgrip 109 is generally U-shaped in side view and extends in a vertical direction transverse to the axial direction of the hammer bit. One end (lower end) of the handgrip 109 in the vertical direction is connected to a lower portion of the rear end of the motor housing 105, and the other end (upper end) is connected to an upper portion of the rear end of a rear cover 108 which covers a rear region of the motor housing 105 and the gear housing 107, via a vibration-absorbing coil spring 161. The coil spring 161 is a feature that corresponds to the "vibration-proofing cushioning material" according to this invention. In this manner, the handgrip 109 is constructed to have a vibration-proof structure which can prevent or reduce transmission of vibration from the body 103 to the handgrip 109.

The motion converting mechanism 113 which serves to convert rotation of the driving motor 111 to linear motion and transmit it to the striking mechanism 115, is formed by a crank mechanism including a crank shaft 121 that is driven by the driving motor 111, a crank arm 12, and a piston 125. The piston 125 is a driving element that drives the striking mechanism 115 and can slide in the axial direction of the hammer bit within a cylinder 127.

The striking mechanism 115 mainly includes a striking element in the form of a striker 129 and an intermediate element in the form of an impact bolt 131. The striker 129 is slidably disposed within the bore of the cylinder 127 and linearly driven via the action of an air spring which is caused within the cylinder bore by sliding movement of the piston 125, and the impact bolt 131 is slidably disposed within the tool holder and transmits the kinetic energy of the striker 129 to the hammer bit 119.

The hammer bit 119 held by the tool holder is rotationally driven together with the tool holder via the power transmitting mechanism 117 by the driving motor 111. As shown in FIG. 1, the power transmitting mechanism 117 includes an intermediate gear 133 that is rotationally driven by the driving motor 111, an intermediate shaft 135, a first bevel gear 137 that rotates together with the intermediate shaft 135, and a second bevel gear 139 that engages with the first bevel gear 137 and rotates on a longitudinal axis of the body 103. The power transmitting mechanism 117 transmits rotation of the driving motor 111 to the tool holder and further to hammer bit 119 held by the tool holder.

A clutch, which is not shown, is disposed between the intermediate gear 133 and the intermediate shaft 135 and serves to transmit the rotating output of the driving motor 111 to the hammer bit 119 or to interrupt such transmission. The clutch is mounted such that it is fixed in the circumferential direction and slidable in the axial direction with respect to the intermediate shaft 135. The clutch can be switched by sliding along the intermediate shaft 135 between a power transmission state in which the clutch is engaged with clutch teeth of the intermediate gear 133 and a power transmission interrupted state in which such engagement is released.

The clutch can be switched by manually operating an operation mode switching dial 151 for selecting (switching) an operation mode of the hammer bit 119. The operation mode switching dial 151 is a feature that corresponds to the "operation mode switching member" according to this invention. The operation mode switching dial 151 is disposed externally on the upper surface of the body 103 (above the crank mechanism) such that it can be turned in a horizontal plane around a vertical axis of rotation 151*a* extending transversely to an axis of the hammer bit 119. When the operation mode switching dial 151 is turned, the clutch of the power transmitting mechanism 117 is switched either to the power transmission state or to the power transmission interrupted state via a clutch switching mechanism 118. The clutch switching mechanism 118 is disposed within the gear housing 107 (as partly shown in FIG. 1) and serves to convert rotation of the operation mode switching dial 151 to linear motion and cause the clutch to move along the intermediate shaft 135. The clutch switching mechanism 118 is not directly related to this invention and therefore it is not described in further detail.

The operation mode is selected by turning the operation mode switching dial 151 around the rotation axis 151*a*. In this embodiment, the operation mode switching dial 151 can switch among first hammer mode, second hammer mode, hammer drill mode and neutral mode. The first hammer mode, second hammer mode, hammer drill mode and neutral mode are appropriately marked on an outer surface of the body 103 around the operation mode switching dial 151.

When the first or second mode is selected by turning the operation mode switching dial 151, the clutch of the power transmitting mechanism 117 is placed in the power transmission interrupted state by the clutch switching mechanism 118. In this state, when the driving motor 111 is driven, only the motion converting mechanism 113 is driven. The rotating output of the driving motor 111 is transmitted to the motion converting mechanism 113, and the piston 125 of the motion converting mechanism 113 is caused to reciprocate within the bore of the cylinder 127. When the piston 125 is caused to reciprocate, the motion of the piston 125 is transmitted to the hammer bit 119 via the striker 129 and the impact bolt 131 and the hammer bit 119 performs a striking movement. Thus, in the first or second mode in which the clutch is placed in the power transmission interrupted state, the hammer bit 119 performs hammering operation on a workpiece such as a concrete only by a striking movement (hammer movement).

When the hammer drill mode is selected, the clutch of the power transmitting mechanism 117 is placed in the power transmission state by the clutch switching mechanism 118. In this state, when the driving motor 111 is driven, not only the motion converting mechanism 113 but the power transmitting mechanism 117 is driven. The rotating output of the driving motor 111 is transmitted to the tool holder and the hammer bit 119 held by the tool holder via the intermediate gear 133, the clutch, the intermediate shaft 135 and the first and second bevel gears 137, 139. Thus, in the hammer drill mode in which the clutch is placed in the power transmission state, the hammer bit 119 performs hammer drill operation on a workpiece by striking movement in its axial direction and rotation in its circumferential direction (drilling movement).

An operating member (switching structure) for starting and stopping the driving motor 111 is now described with reference to FIGS. 6 to 9. A first operating member 143 for turning on and off a first switch 141 (for placing it in an on state or an off state) is provided on the handgrip 109 side, and a second operating member 145 for turning on and off a second switch 146 (for placing it in an on state or an off state) is provided on the body 103 side. The first operating member 143 and the second operating member 145 are features that correspond to the "manual operating member" and the "second manual operating member", respectively, according to this invention. The first operating member 143 is a trigger-type switch which can be operated by depressing, and the second operating member 145 is a lever-type switch which can be operated by pushing. The first operating member 143 and the second operating member 145 are opposed to each other in the fore-and-aft direction (the axial direction of the hammer bit 119) such that both can be operated by fingers of the user's hand holding the handgrip 109. Therefore, the operating section can be operated by one hand, so that its operability can be improved.

The first operating member 143 is disposed in a handgrip internal space 109*b* of the hollow handgrip 109. The first operating member 143 extends in a longitudinal direction of the handgrip 109 (vertical direction transverse to the axial direction of the hammer bit 119) and is mounted to the handgrip 109 at its lower end in the extending direction by a mounting shaft 142 such that it can pivot in the fore-and-aft direction (the axial direction of the hammer bit 119). The first operating member 143 can be pivotally operated between an off position in which the first switch 141 is turned off (or "placed in the off state") and an on position in which the first switch 141 is turned on (or "placed in the on state") by depressing its upper portion by user's finger.

The first operating member 143 is normally biased away from the on position toward the off position by a spring (not shown) which is incorporated in the first switch 141 in order to hold the first switch 141 in the off state by the biasing force. The spring here is a feature that corresponds to the "biasing means" according to this invention. Therefore, in the state in which the first operating member 143 is not depressed, the upper portion of the first operating member 143 is held in the off position in which it protrudes forward through a front opening of the handgrip 109 (see FIG. 6). In the on position in which it is depressed by finger or pressed in by a slide plate 153 which is described below, the first operating member 143 is housed in the internal space 109*b* of the handgrip 109 such that its front surface is substantially flush with the outer surface of the front of the grip (see FIG. 7). The first switch 141 is designed as an automatic return type on-off switch which is biased so as to be held in the off state by the incorporated spring.

The second operating member 145 is disposed in a rear internal space 103*a* within the body 103. The rear internal space 103*a* here is a feature that corresponds to the "housing space" according to this invention. The rear internal space 103*a* is provided as a space surrounded by the gear housing 107 and the rear cover 108 which covers a rear surface region of the gear housing 107. The second operating member 145 is a rectangular plate-like member (see FIG. 5) which is opposed to the first operating member 143 and extends in the vertical direction transverse to the axial direction of the hammer bit 119. The second operating member 145 has a shaft 145*c* on its lower end in its extending direction and can pivot in the fore-and-aft direction (the axial direction of the hammer bit 119) with the shaft 145*e* supported by a receiving member 149.

The rear region of the body 103 in which the second operating member 145 is disposed is a region remote from the hammer bit 119 and hidden when viewed from the hammer bit 119 side. Therefore, the second operating member 145 disposed in this rear region is not easily affected by dust of the workpiece (concrete) which is generated during hammering or hammer drill operation, so that the dust resistance is enhanced.

Figure 6:
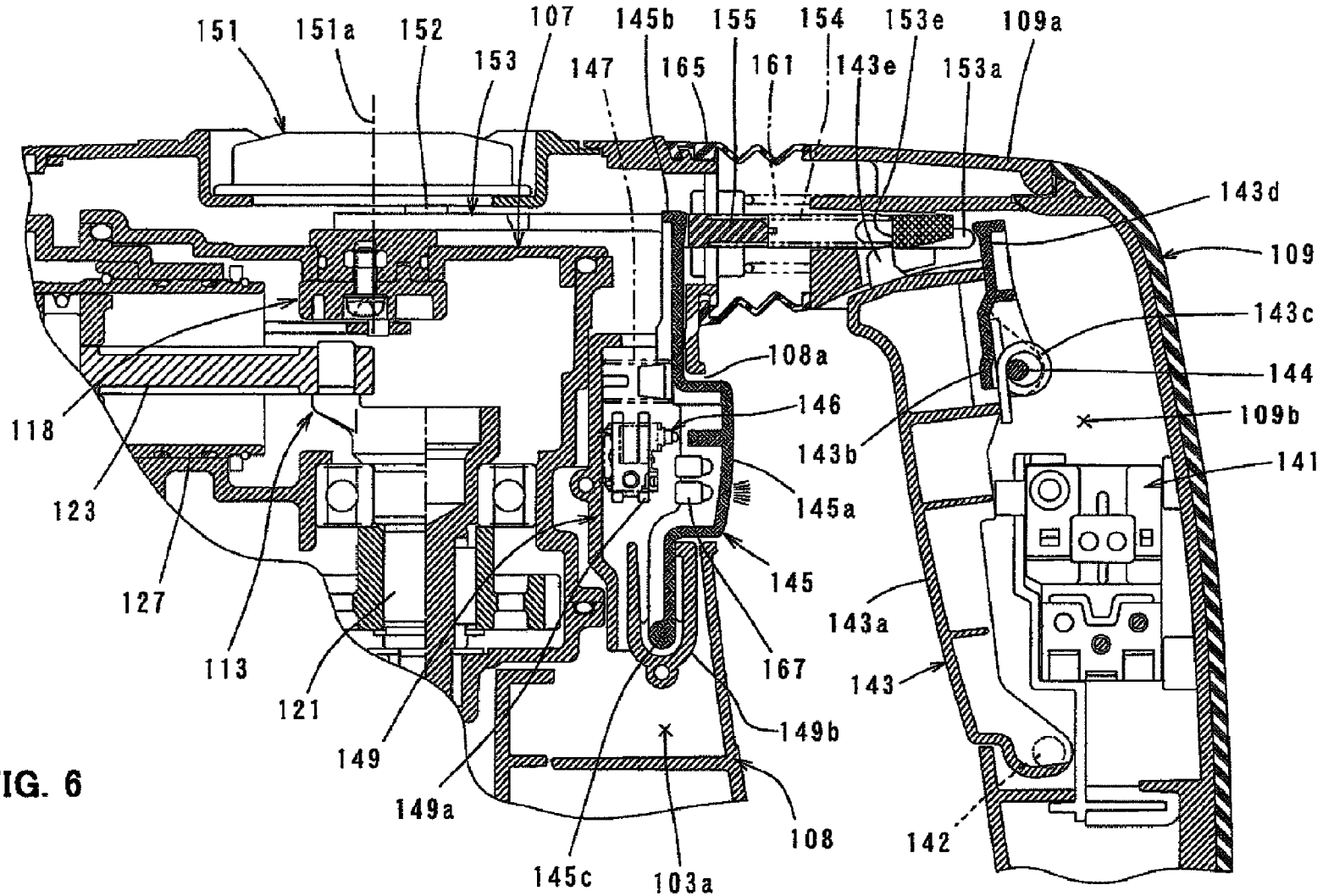
FIG. 6 is an enlarged sectional view showing operation of the slide plate which is operated by an operation mode switching dial, and first and second operating members which are operated by the slide plate, in neutral mode.
Figure 7:
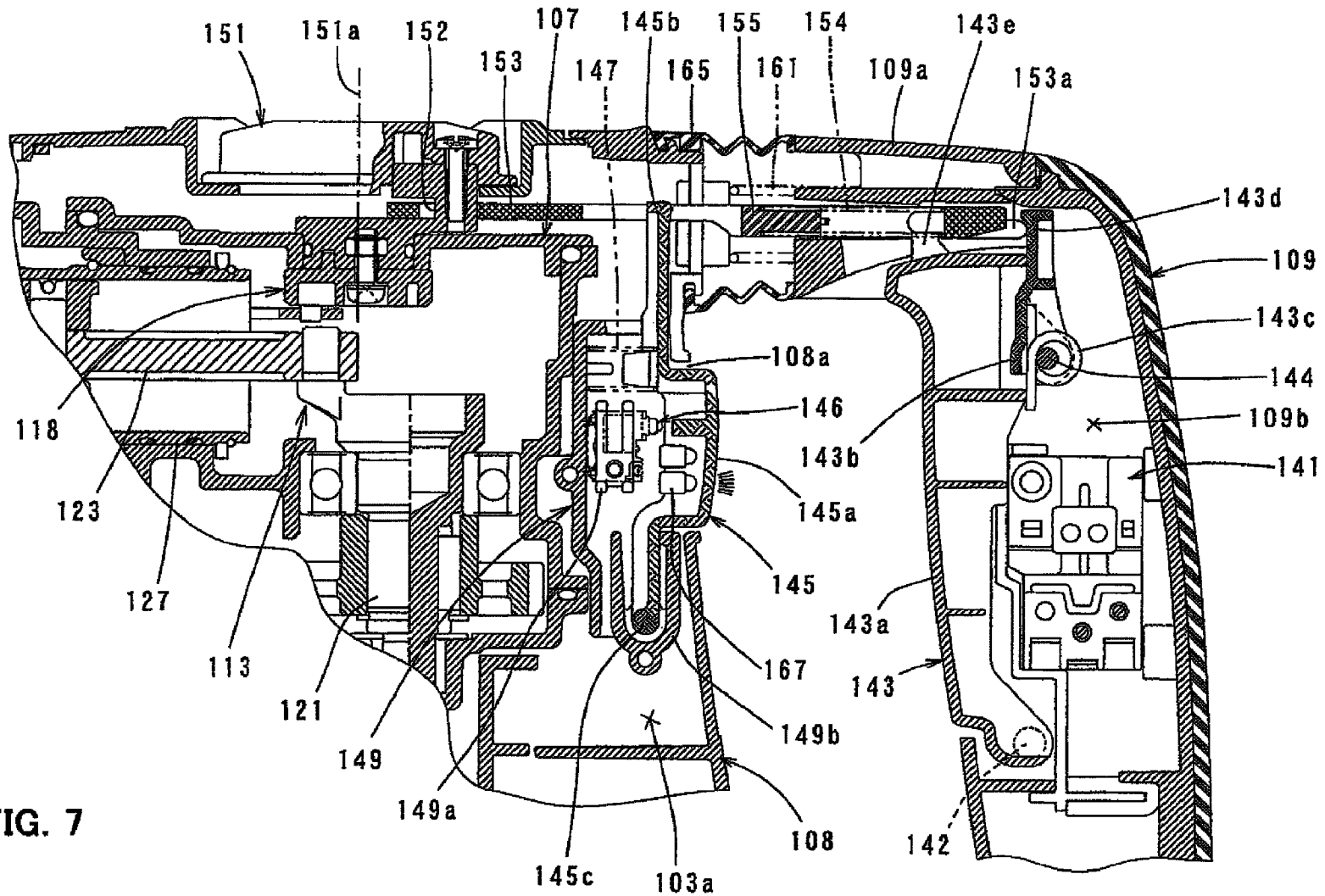
FIG. 7 is an enlarged sectional view showing operation of the slide plate which is operated by the operation mode switching dial, and the first and second operating members which are operated by the slide plate, in second hammer mode.

The second operating member 145 is pivotally operated between an off position in which it is not operated by user's finger and an on position in which it is operated by user's finger to apply a pressing force to the second switch 146. The second operating member 145 is normally biased away from the on position toward the off position by a spring 147. Further, a push button 145*a* to be pushed forward by the user's finger is formed in about the middle of the rear surface of the second operating member 145 in its extending direction. Therefore, as long as the push button 145*a* of the second operating member 145 is not pressed by user's finger, the second operating member 145 is held in the off position and the push button 145*a* protrudes rearward through an opening 108*a* of the rear cover 108. This state is shown in FIGS. 6 and 7. Further, once the second switch 146 is pressed by the second operating member 145 and turned on, the second switch 146 is held in the on state until it is pressed again.

Figure 5:
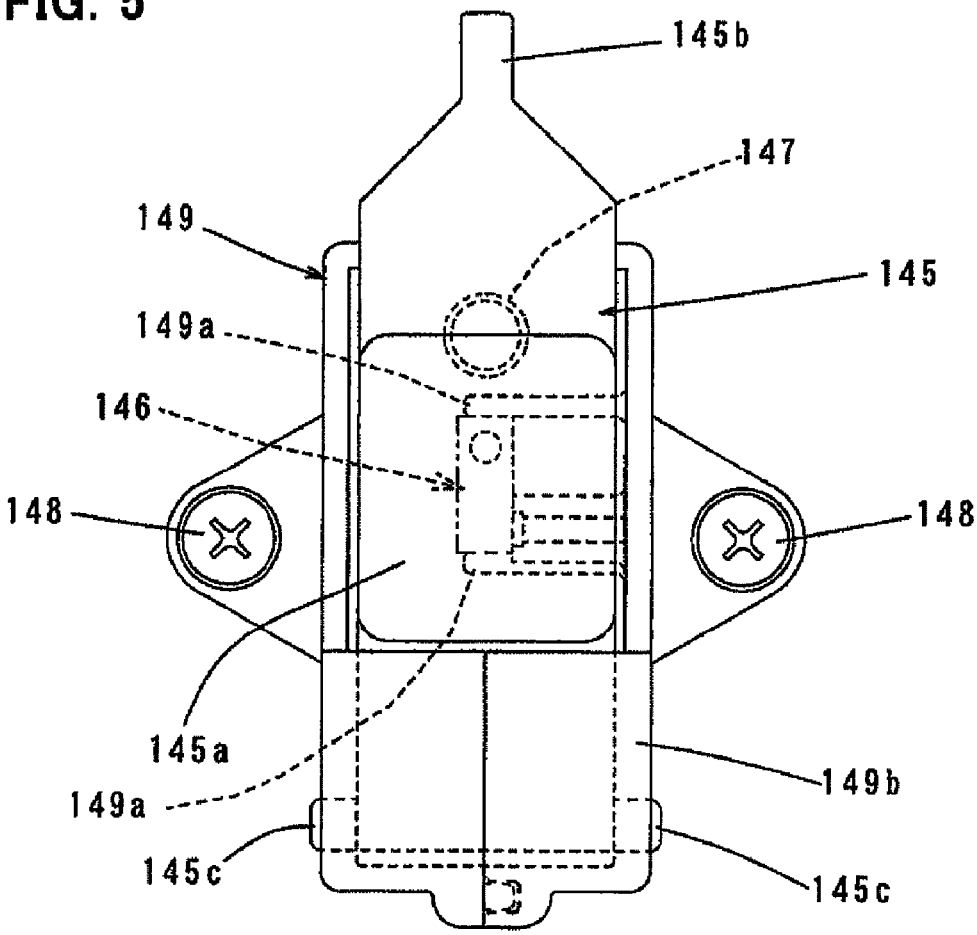
FIG. 5 is a view showing a second operating member and a receiving member as viewed from a direction of arrow B in FIG. 1.

The receiving member 149 is provided as a member for supporting the second switch 146 and the second operating member 145 and fastened to the gear housing 107 by screws 148 (see FIG. 5). The receiving member 149 has a plurality of claws 149*a* that hold the second switch 146 therebetween in the vertical direction. Further, the receiving member 149 has a generally U-shaped receiving portion 149*b* that supports the second operating member 145. Within the receiving portion 149*b*, a lower region of the second operating member 145 is housed and the shaft 145*c* is rotatably supported. Therefore, the lower region of the second operating member 145 and the generally U-shaped receiving portion 149*b* overlap each other. Due to the labyrinth effect of such a structure, the effect of preventing entry of dust into the pivot shaft receiving area of the second operating member 145 can be obtained, so that the dust resistance can be further enhanced, coupled with the above-described configuration effect of dust proofing.

Further, in the second operating member 145, at least the push button 145*a* is formed of a translucent material, and a light 167 such as a light emitting diode (LED) is disposed inside the push button 145*a*. The light 167 is turned on or off according to the position of the first operating member 143 or the second operating member 145 or to the selected operation mode, which will be described below.

Next, a slide plate 153 is explained which is provided as a switch actuating means which forcefully and selectively locks the first operating member 143 or the second operating member 145 in the on position, or releases such lock to allow it to be operated by user's finger, according to the mode selection of the operation mode switching dial 151. This slide plate 153 is shown in FIGS. 2 and 6 to 13. The slide plate 153 is linearly moved in the axial direction of the hammer bit 119 via the eccentric shaft 152 according to the turning movement of the operation mode switching dial 151 which is operated to switch the operation mode.

Figure 2:
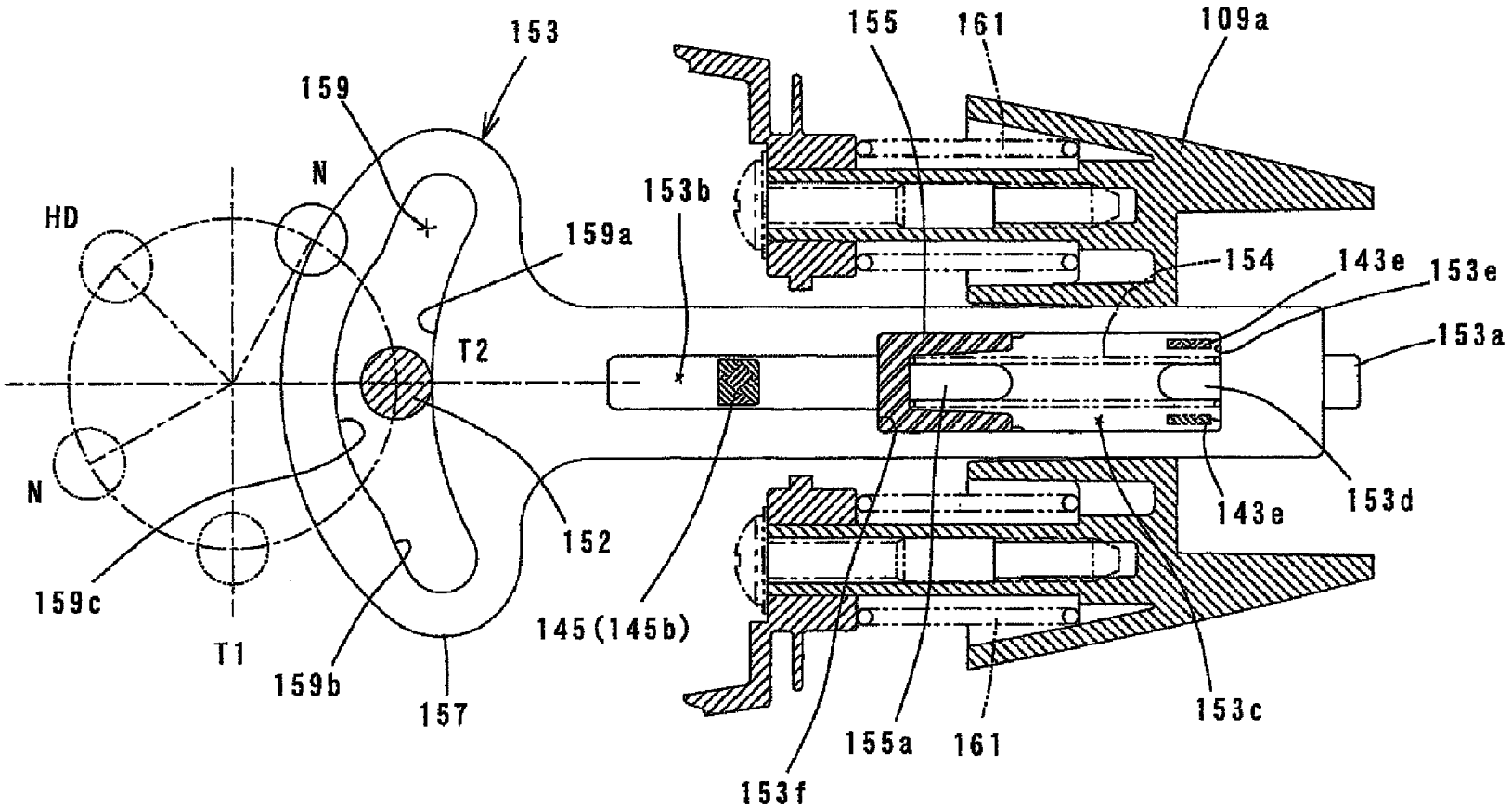
FIG. 2 is a plan view for illustrating the construction of a switch-actuating slide plate and the arrangement of the slide plate and vibration absorbing coil springs.
Figure 11:
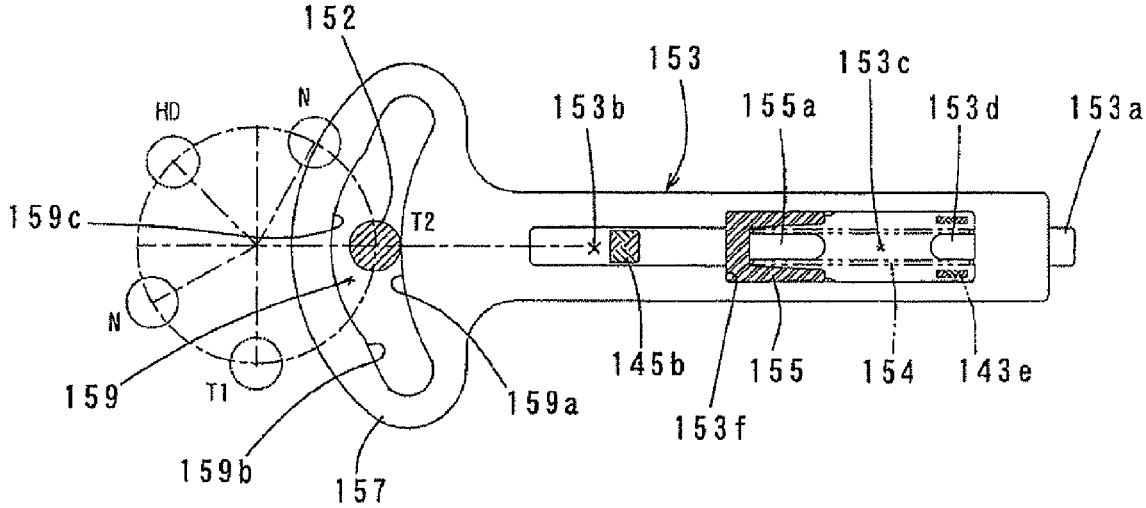
FIG. 11 is a view showing movement of the operation mode switching dial and the slide plate in second hammer mode.

As shown in FIG. 2, the slide plate 153 is an elongate member extending in the axial direction of the hammer bit 119. The slide plate 153 extends to the handgrip 109 side through an upper connecting region 109*a* of the handgrip 109 for connection with the body 103. When second hammer mode T2 is selected with the operation mode switching dial 151, the slide plate 153 is moved toward the handgrip 109 to a rear end position by an eccentric shaft 152. Thus the slide plate 153 releases the lock of the second operating member 145, while pushing the first operating member 143 rearward to the on position and locking it in the on position. This state is shown in FIGS. 2, 7 and 11. When the operation mode switching dial 151 is switched from second hammer mode T2 to first hammer mode T1 or hammer drill mode HD, the slide plate 153 is moved forward away from the handgrip 109, so that it releases the lock of the first operating member 143, while pushing the second operating member 145 forward to the on position and locking it in the on position. This state is shown in FIGS. 8, 9, 12 and 13. The structure of connecting the slide plate 153 and the eccentric shaft 152 will be described below in detail.

As shown in FIG. 6, the first operating member 143 includes an operating member body 143*a* which has a generally U-shaped cross section (see FIG. 4) and is designed to be depressed by user's finger, a lever 143*b* which has a generally U-shaped cross section (see FIG. 4) and is mounted at its lower end to the operating member body 143*a* such that it can rotate on a fulcrum or pivot (mounting shaft) 144 in the direction of travel of the slide plate 153 (in the direction of pivotal movement of the operating member body 143*a*), and a vibration-absorbing torsion spring 143*c* which elastically connects the lever 143*b* to the operating member body 143*a*.

The lever 143*b* is mounted to an upper end region of the operating member body 143*a* and extends upward in such a manner as to protrude from an upper end surface of the operating member body 143*a*. An upper end portion 143*d* of the lever 143*b* faces a rear end projection 153*a* of the slide plate 153. One end of the torsion spring 143*c* is engaged with the lever 143*b* and the other end is engaged with the operating member body 143*a*, so that the torsion spring 143*c* exerts a biasing force to rotate the lever 143*b* forward. An initial load (mounting load) of the torsion spring 143*c* which is applied to the lever 143*b* upon assembly is larger than a load of fully depressing the operating member body 143*a* by user's finger (a load which is applied to the spring incorporated in the first switch 141 upon completion of the depressing operation to the on position). Therefore, when the slide plate 153 moves rearward and pushes the upper end portion 143*d* of the lever 143*b* with the rear end projection 153*a*, the lever 143*b* and the operating member body 143*a* are rotated rearward together in one piece. Specifically, the operation of the first operating member 143 to the on position by the slide plate 153 is performed with the lever 143*b* and the operating member body 143*a* held in one piece, so that such operation can be reliably preformed. Further, the maximum position limit of forward rotation of the lever 143*b* is defined by contact of the front surface of the lever 143*b* with the operating member body 143*a*.

The above-described torsion spring 143*c* is provided as an elastic member that absorbs vibration which is caused in the body 103 mainly in the fore-and-aft direction (the axial direction of the hammer bit 119) and prevents or reduces transmission of vibration from the slide plate 153 to the handgrip 109 via the first operating member 143 when a hammering operation is performed in the state in which the first operating member 143 is forcefully locked in the on position by the slide plate 153 (in second hammer mode T2).

The second operating member 145 extends upward within the rear internal space 103*a*, and an upper end 145*b* of the second operating member 145 is movably inserted into a slot 153*b* (opening) which is formed in the slide plate 153 and extends in a longitudinal direction of the slide plate 153. When the slide plate 153 is moved forward, the second operating member 145 is pushed forward to the on position by a linkage 155 which is elastically connected to the slide plate 153 via a coil spring 154 and locked in the on position. The coil spring 154 is a feature that corresponds to the "second elastic member" according to this invention.

As shown in FIG. 2, an opening 153*c* having a larger width than the slot 153*b* is formed in the slide plate 153 and extends contiguously rearward from the slot 153*b*, and the linkage 155 and the coil spring 154 are disposed within the opening 153*c*. The linkage 155 can move in the fore-and-aft direction with respect to the slide plate 153 and is biased forward by the coil spring 154 and held in a position of engagement with a stepped portion 153*f* which is formed in the boundary between the slot 153*b* and the opening 153*c*. The biasing force of the coil spring 154 is larger than the biasing force of the spring 147 which biases the second operating member 145 toward the off position. Therefore, when the slide plate 153 is moved forward, the linkage 155 moves together with the slide plate 153, and on its way, it engages with the upper end 145*b* of the second operating member 145. Thus, the linkage 155 moves the second operating member 145 to the on position and locks it in the on position. Specifically, in the state in which the second operating member 145 is forcefully locked in the on position by the slide plate 153, the second operating member 145 is elastically connected to the slide plate 153 via the coil spring 147. When the slide plate 153 is further moved forward in the state in which the second operating member 145 is forcefully locked in the on position, the linkage 155 moves with respect to the slide plate 153 while compressing the coil spring 154. Thus, the difference between the amount of travel of the second operating member 145 and the amount of travel of the slide plate 153 which is caused after engagement between the linkage 155 and the second operating member 145 can be accommodated.

Further, the coil spring 154 disposed within the slot 153*b* is loosely fitted onto a columnar guide 153*d* of the slide plate 153 and a columnar guide 155*a* of the linkage 155 which are opposed to each other, so that a stable supporting structure for the coil spring 154 can be obtained.

Next, a structure of connecting the eccentric shaft 152 of the operation mode switching dial 151 and the slide plate 153 is explained mainly with reference to FIG. 2. A connecting part 157 is formed on a front end of the slide plate 153 and has an engagement slot 159 extending in a horizontal direction (lateral direction) transverse to the direction of travel (the longitudinal direction) of the slide plate 153. The eccentric shaft 152 is loosely engaged in the engagement slot 159. The eccentric shaft 152 is disposed in a position displaced a predetermined distance from the rotation axis 151*a* of the operation mode switching dial 151. Therefore, when the operation mode switching dial 151 is turned around the rotation axis 151*a*, the eccentric shaft 152 moves the slide plate 153 in the fore-and-aft direction by the component of motion of the eccentric shaft 152 in the fore-and-aft direction (the axial direction of the hammer bit 119) while moving within the engagement slot 159 in the extending direction of the engagement slot 159 (the lateral direction). Specifically, the eccentric shaft 152 moves the slide plate 153 rearward by pushing a rear engagement surface 159*a* of the engagement slot 159, and it moves the slide plate 153 forward by pushing a front engagement surface 159*b* of the engagement slot 159. Further, when the eccentric shaft 152 is in its front end position or rear end position, the eccentric shaft 152 is centrally located within the engagement slot 159 in its extending direction.

In this embodiment, dial settings for the hammer drill mode HD, first hammer mode T1 and second hammer mode T2 are made and marked at (different) predetermined angular intervals around the rotation axis 151*a* of the operation mode switching dial 151, and neutral mode N is set and marked between the hammer drill mode HD and the first hammer mode T1 and between the hammer drill mode HD and the second hammer mode T2.

Figure 12:
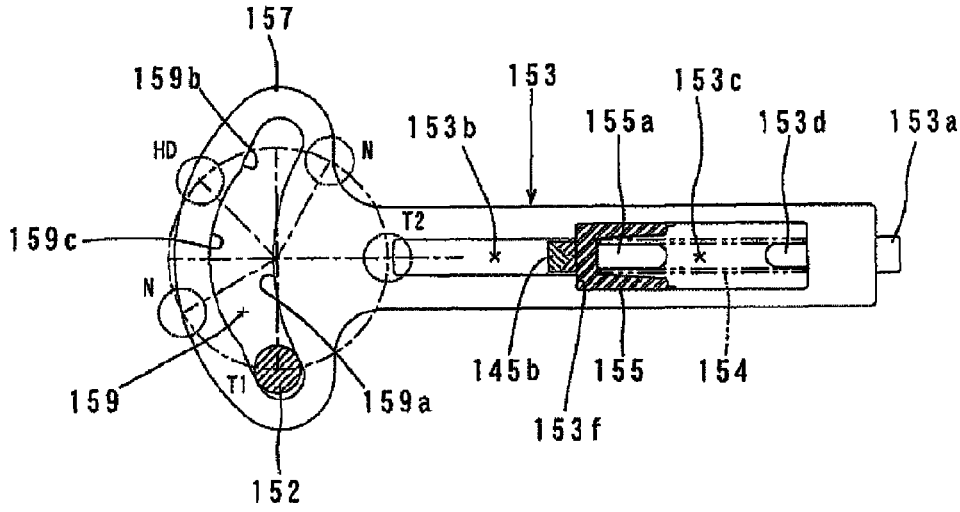
FIG. 12 is a view showing movement of the operation mode switching dial and the slide plate in first hammer mode.
Figure 13:
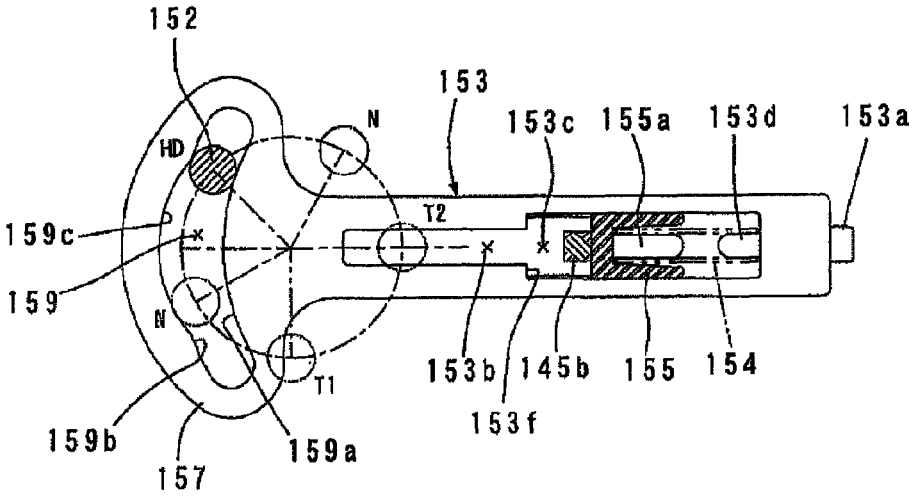
FIG. 13 is a view showing movement of the operation mode switching dial and the slide plate in hammer drill mode.

When the eccentric shaft 152 is caused to revolve rearward around the rotation axis 151*a* and the second hammer mode T2 is selected, the eccentric shaft 152 is centrally located within the engagement slot 159 (the eccentric shaft 152 is located in its rear end position). At this time, as described above, the slide plate 153 is moved to its rear end position, and the first operating member 143 is pushed rearward by the slide plate 153 and locked in the on position (see FIG. 7). When the eccentric shaft 152 is caused to revolve forward in a clockwise direction around the rotation axis 151*a* from the position of the second hammer mode T2 and the first hammer mode T1 is selected, the eccentric shaft 152 is located toward one end (lower end as shown in FIG. 12) within the engagement slot 159 in the extending direction of the engagement slot 159. When the eccentric shaft 152 is caused to revolve forward in a counterclockwise direction around the rotation axis 151*a* from the position of the second hammer mode T2 and the hammer drill mode HD is selected, the eccentric shaft 152 is located toward the other end (upper end as shown in FIG. 13). Further, when the first hammer mode T1 or the hammer drill mode HD is selected, the slide plate 153 is moved forward and the second operating member 145 is pushed forward by the slide plate 153 and locked in the on position (see FIGS. 8 and 9).

Figure 10:
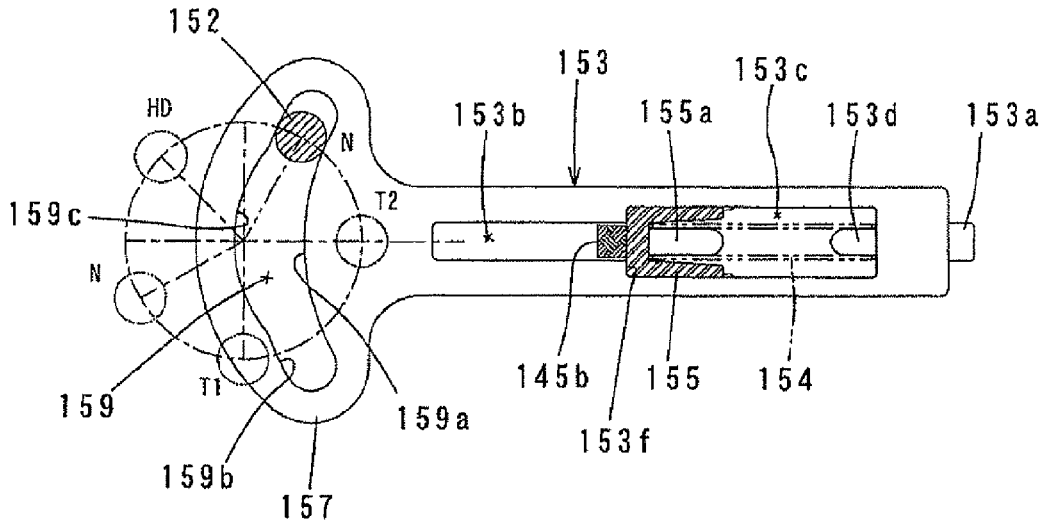
FIG. 10 is a view showing movement of the operation mode switching dial and the slide plate in neutral mode.

When the neutral mode N between the second hammer mode T2 and the hammer drill mode HD is selected, as shown in FIGS. 6 and 10, the slide plate 153 is located at about the midpoint position in the direction of travel. At this time, the rear end projection 153*a* of the slide plate 153 is disengaged from the lever 143*b* of the first operating member 143, and the linkage 155 is disengaged from the upper end 145*b* of the second operating member 145. Specifically, in the neutral mode N between the second hammer mode T2 and the hammer drill mode HD, the first operating member 143 and the second operating member 145 can be placed in the off positions. Further, in the neutral mode N between the second hammer mode T2 and the hammer drill mode HD and in the neutral mode N between the hammer drill mode HD and the first hammer mode T1, the hammer bit 119 (the tool holder) can be freely rotated in order to be set in normal orientation when operating in the hammer mode.

In this embodiment, the engagement slot 159 of the slide plate 153 has an arcuate shape curved forward (toward the hammer bit 119) (arched toward the handgrip 109). Therefore, when the eccentric shaft 152 is caused to revolve, the amount of rearward travel of the slide plate 153 which corresponds to the angle of rotation of the operation mode switching dial 151 differs from the amount of travel of the component of motion of the eccentric shaft 152 in the fore-and-aft direction. Specifically, when the eccentric shaft 152 is caused to revolve from the front end position to the rear end position while pushing the convex arcuate surface or the rear engagement surface 159*a* of the engagement slot 159, the amount of rearward travel of the slide plate 153 is smaller than the amount of travel of the component of rearward motion of the eccentric shaft 152 in a forward region in which the eccentric shaft 152 moves from higher to lower areas of the convex arcuate surface (in a region in which it moves toward the position of the first hammer mode T1 and in a region in which it moves toward the position of the neutral mode N between the second hammer mode T2 and the hammer drill mode HD), while it is larger in a rearward region in which the eccentric shaft 152 moves from the lower to higher areas (in a region in which it passes the position of the first hammer mode T1 or the neutral mode N and moves toward the position of the second hammer mode T2), wherein the border between the forward and rearward regions is defined by a lateral axis intersecting with the rotation axis 151*a*. Thus, in this embodiment, when the second hammer mode T2 is selected, the amount of travel of the slide plate 153 is made larger in the rearward region. With such a construction, the amount of travel of the slide plate 153 which is required to move the first operating member 143 to the on position can be easily ensured.

Further, when the eccentric shaft 152 moves the slide plate 153 forward by pushing the concave arcuate surface or the front engagement surface 159*b* of the engagement slot 159, the amount of travel of the slide plate 153 is larger than the amount of travel of the component of forward motion of the eccentric shaft 152 in a rearward region in which the eccentric shaft 152 moves from lower to higher areas of the concave arcuate surface, while it is smaller in a forward region in which it moves from higher to lower areas of the concave arcuate surface. In other words, such is the reverse of the above-described phenomenon in rearward movement.

Further, in this embodiment, an escape recess 159*c* is formed in a central region of the front engagement surface 159*b* of the engagement slot 159 in the extending direction of its arc and recessed forward. The escape recess 159*c* is formed by a circular arc surface having a radius corresponding to the distance of displacement of the eccentric shaft 152 (the distance from the rotation axis 151*a* to the center of the eccentric shaft 152). Specifically, when the eccentric shaft 152 moves the slide plate 153 forward by pushing the front engagement surface 159*b* of the engagement slot 159, the eccentric shaft 152 is opposed to the escape recess 159*c* in the forward region or particularly in the vicinity of the end of forward movement. As a result, thereafter, further forward movement of the slide plate 153 is prevented. When the hammer drill mode HD or the first hammer mode T1 is selected, the slide plate 153 moves the second operating member 145 to the on position via the linkage 155. When the slide plate 153 is moved further forward from this position, as shown in FIG. 13, the linkage 155 pushing the second operating member 145 moves with respect to the slide plate 153 while compressively deforming the coil spring 154. Thus, the construction having the escape recess 159*c* in the front engagement surface 159*b* is effective in reducing the amount of relative movement of the linkage 155 with respect to the slide plate 153 in the vicinity of the forward end position of the slide plate 153 (in a region of switching between the hammer drill mode HD and the other neutral mode N) when the slide plate 153 is moved forward, so that undesired compressive deformation of the coil spring 154 can be reduced.

Further, a horn-like projection 143*e* is formed on the upper end of the operating member body 143*a* of the first operating member 143. When the operation mode switching dial 151 is switched to the second hammer mode T2, the slide plate 153 is moved rearward and the rear projection 153*a* of the slide plate 153 pushes the upper end portion 143*d* of the lever 143*b* so that the first operating member 143 is rotated to the on position. At this time, the projection 143*e* enters the opening 153*c* of the side plate 153. This state is shown in FIGS. 7 and 11. When the operation mode switching dial 151 is switched from the second hammer mode T2 to the hammer drill mode HD or the first hammer mode T1 and the slide plate 153 is moved forward, the projection 143*e* is engaged with a rear edge 153*e* of the opening 153*c* so that the first operating member 143 is forcefully returned to the off position.

A pair of right and left vibration-absorbing coil springs 161 are disposed in the upper connecting region 109*a* of the handgrip 109 for connection with the body 103 and elastically connect the handgrip 109 and the body 103. As shown in FIG. 2, the coil springs 161 are disposed in parallel on the opposite sides of the axis of the hammer bit 119 such that they extend and contract in the axial direction of the hammer bit 119. The slide plate 153 is disposed between the coil springs 161 on the axis of the hammer bit 119. The slide plate 153 and the coil springs 161 are covered by a rubber bellows 165.

Operation and usage of the electric hammer drill 101 constructed as described above are now described. FIGS. 6 and 10 show the state in which the neutral mode N is selected by turning the operation mode switching dial 151. In this state, the eccentric shaft 152 is located toward one end of the engagement slot 159, and the slide plate 153 is located at about the midpoint position in the direction of travel. In this state, as shown in FIG. 6, the rear end projection 153*a* of the slide plate 153 is disengaged from the lever 143*b* of the first operating member 143, and the linkage 155 of the slide plate 153 is disengaged from the upper end 145*b* of the second operating member 145. Therefore, both the first operating member 143 and the second operating member 145 are in their off positions, and both the first switch 141 and the second switch 146 are off. Thus, the driving motor 111 is held shut down.

Next, FIGS. 7 and 11 show the state in which the operation mode switching dial 151 is switched from the neutral mode N to the second hammer mode T2. In this state, rotation of the operation mode switching dial 151 is transmitted as linear motion to the clutch of the power transmitting mechanism 117 via the clutch switching mechanism 118, and the clutch is switched to the power transmission interrupted state. At the same time, the eccentric shaft 152 is caused to revolve to the rear end position and moves the slide plate 153 rearward. Then, as shown in FIG. 7, the rear end projection 153*a* of the slide plate 153 pushes the upper end portion 143*d* of the lever 143*b* of the first operating member 143 rearward. As a result, the first operating member 143 pivots around the mounting shaft 142 to the on position with the lever 143*b* and the operating member body 143*a* held in an integrally connected state by the biasing force of the torsion spring 143*c*, and thus turns on the first switch 141. Specifically, the first operating member 143 is forcefully locked in the on position by the slide plate 153.

In this state, when the push button 145*a* of the second operating member 145 is pushed forward by user's finger, the second operating member 145 pivots around the shaft 145*c* to the on position and turns on the second switch 146. Thus, the driving motor 111 is driven, and as described above, this energized state is maintained even if the second operating member 145 is released. Therefore, without need of continuing pressing the second operating member 145 by finger, the user can continuously drive the driving motor 111 to cause the hammer bit 119 to perform linear striking movement via the motion converting mechanism 113 and the striking mechanism 115 and thus can continuously perform a hammering operation on a workpiece. The second hammer mode T2 is a feature that corresponds to the "first operation mode" according to this invention. In order to stop the hammering operation, the second operating member 145 is pressed again. Then the second switch 146 is turned off and the driving motor 111 is stopped.

Figure 3:
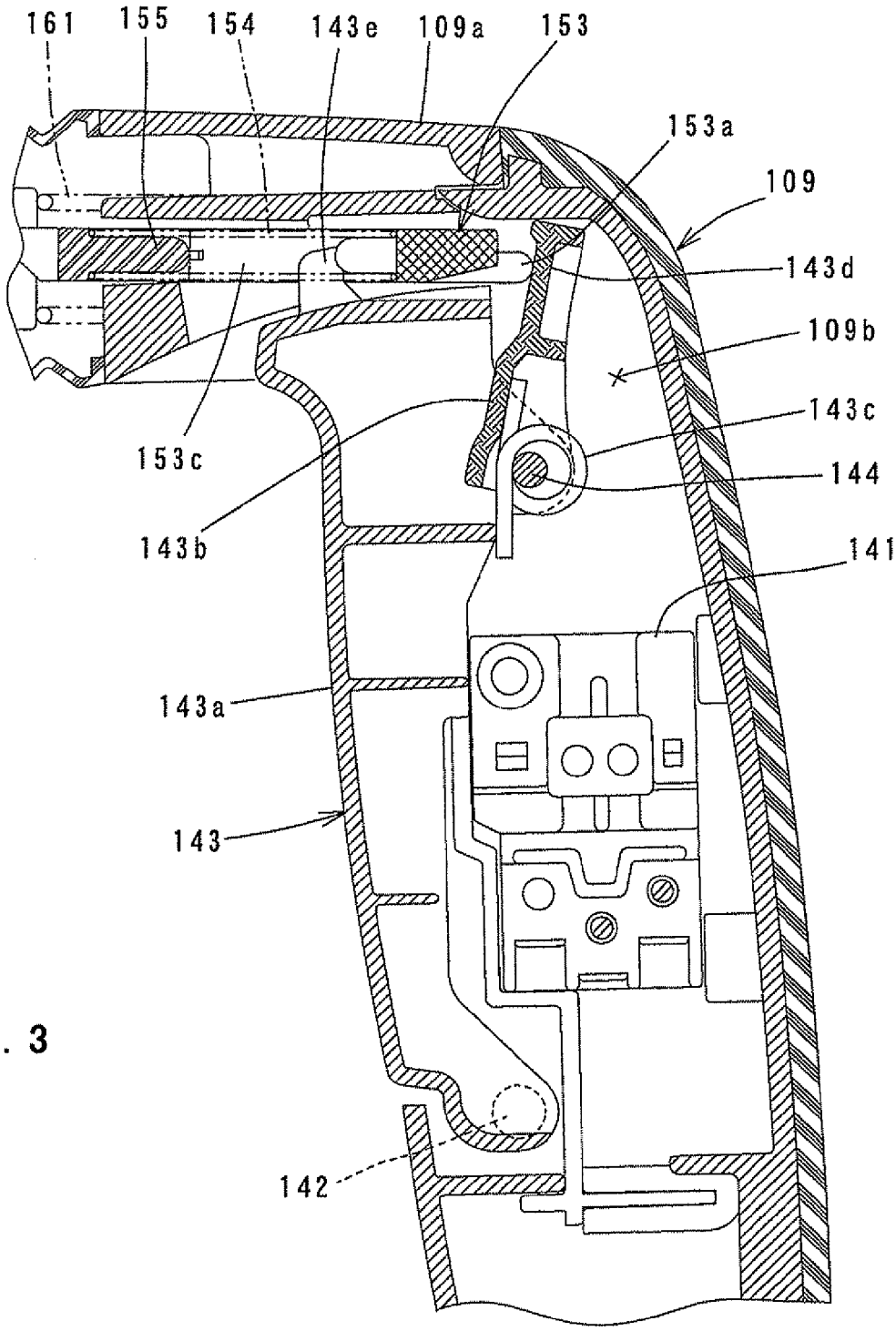
FIG. 3 is a sectional view showing the operating status of a handgrip.
Figure 4:
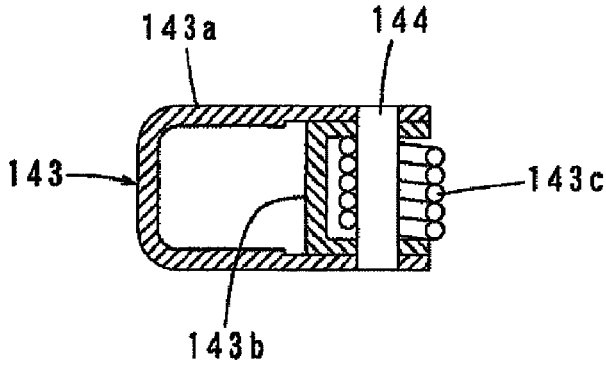
FIG. 4 is a sectional view taken along line A-A in FIG. 1.

In this case, in operation using the electric hammer drill 101, the user holds the handgrip 109 and presses the hammer bit 119 against the workpiece while applying a pressing force to the body 103 in the axial direction of the hammer bit 119. Therefore, when the hammer bit 119 is pressed against the workpiece, the handgrip 109 pivots forward toward the body 103 around a pivot 163. Then the lever 143*b* of the first operating member 143 is pushed further rearward by the slide plate 153 and pivots around the fulcrum 144 against the torsion spring 143*c* so that the front surface of the lever 143*b* is disengaged from the rear surface of the operating member body 143*a*. This state is shown in FIG. 3. Thus, the first operating member 143 is elastically connected to the slide plate 153 in the state in which it is forcefully locked in the on position by the slide plate 153. Therefore, even if the slide plate 153 vibrates together with the body 103 due to vibration caused in the body 103 during hammering operation, transmission of vibration from the slide plate 153 to the first operating member 143 can be prevented or reduced by the torsion spring 143*c*.

Figure 8:
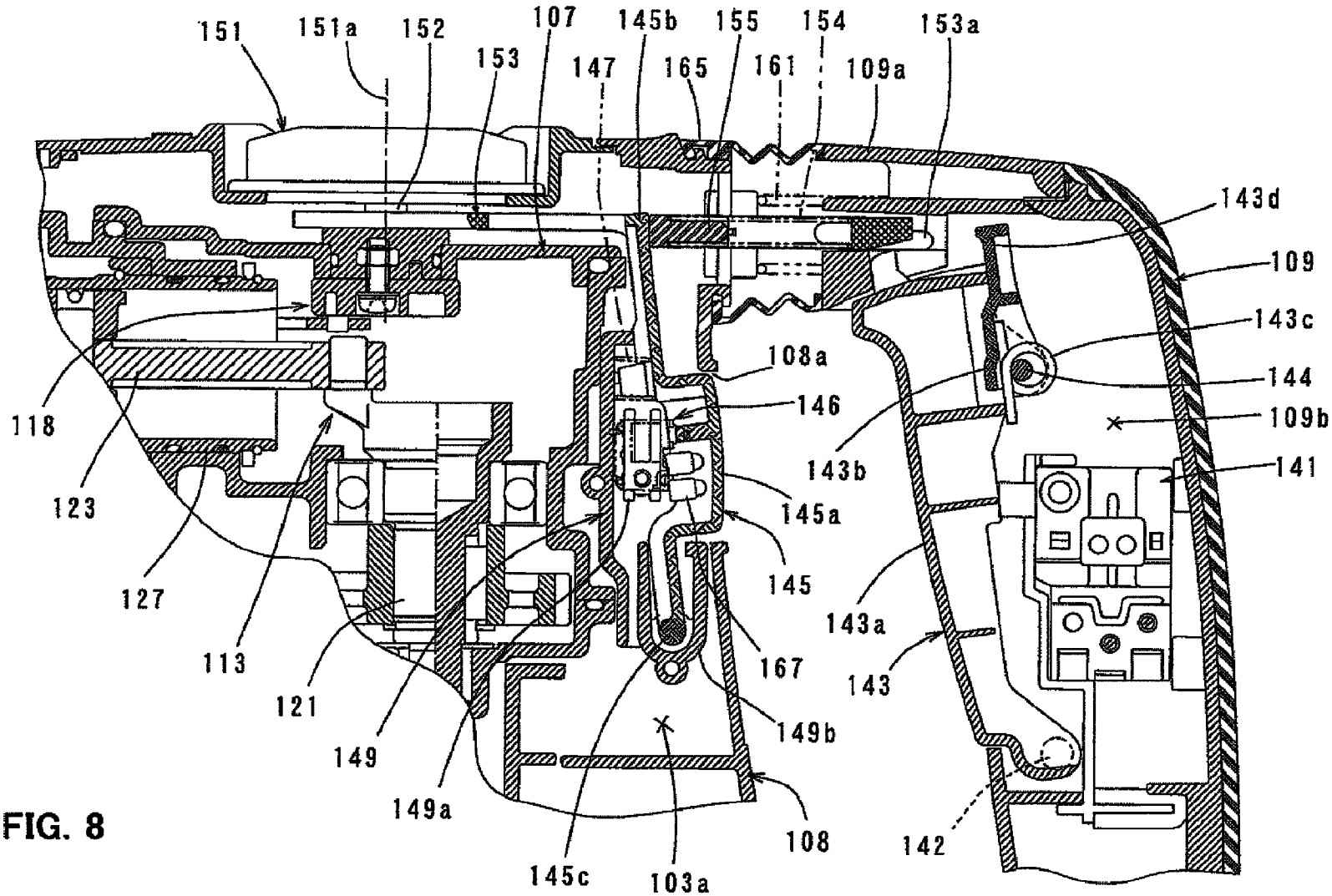
FIG. 8 is an enlarged sectional view showing operation of the slide plate which is operated by the operation mode switching dial, and the first and second operating members which are operated by the slide plate, in first hammer mode.

FIGS. 8 and 12 show the state in which the first hammer mode T1 is selected with the operation mode switching dial 151. In this state, the clutch of the power transmitting mechanism 117 is in the power transmission interrupted state. At the same time, the eccentric shaft 152 is located at about the midpoint position in its travel in the fore-and-aft direction. Thus the slide plate 153 is moved forward when viewed from its rear end position in the second hammer mode T2. Therefore, as shown in FIG. 8, the linkage 155 of the slide plate 153 is engaged with the upper end 145*b* of the second operating member 145 and pushes it forward. Then the second operating member 145 pivots forward to the on position around the shaft 145*c* and turns on the second switch 146.

By the forward movement of the slide plate 153, the rear end projection 153*a* of the slide plate 153 is disengaged from the lever 143*b* of the first operating member 143. Thus, the lock of the first operating member 143 is released and the first operating member 143 is allowed to be operated by user's finger. Therefore, the driving motor 111 is driven when the operating member body 143*a* of the first operating member 143 is depressed by user's finger to turn on the first switch 141, while the driving motor 111 is stopped when the depressing of the first switch 141 is released. In the first hammer mode T1, the clutch of the power transmitting mechanism 117 is in the power transmission interrupted state, so that the hammer bit 119 performs only linear striking movement when the driving motor 111 is driven. Thus, in the first hammer mode T1, the user can arbitrarily start and stop the driving motor 111 by operating the first operating member 143 by finger in order to intermittently (sporadically) perform a hammering operation on a workpiece by the hammer bit 119. The first hammer mode T1 is a feature that corresponds to the "second operation mode" according to this invention.

Figure 9:
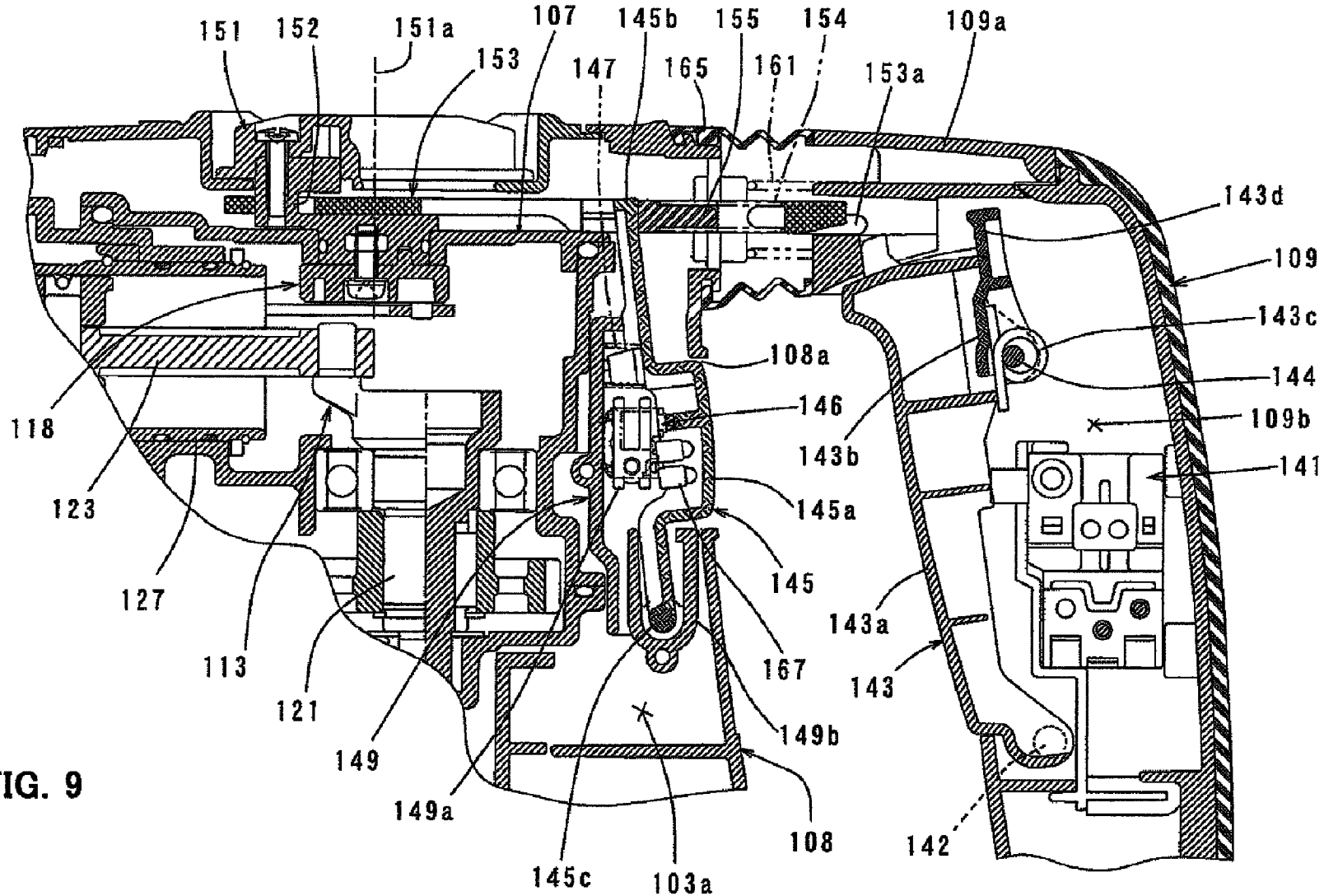
FIG. 9 is an enlarged sectional view showing operation of the slide plate which is operated by the operation mode switching dial, and the first and second operating members which are operated by the slide plate, in hammer drill mode.

FIGS. 9 and 13 show the state in which the hammer drill mode HD is selected with the operation mode switching dial 151. In this state, the clutch of the power transmitting mechanism 117 is placed in the power transmission state. At the same time, the eccentric shaft 152 is revolved further forward than in the first hammer mode T1. Thus, as shown in FIG. 13, the slide plate 153 is moved forward by the eccentric shaft 152, but the linkage 155 is prevented from moving further forward when the second operating member 145 reaches its on position. Therefore, the linkage 155 which is connected to the slide plate 153 via the coil spring 154 moves with respect to the slide plate 153 while compressively deforming the coil spring 154. Thus, the difference between the amount of travel of the second operating member 145 and the amount of travel of the slide plate 153 is accommodated. When the second operating member 145 is pivoted to the on position, the second switch 146 is turned on.

Further, by the forward movement of the slide plate 153, like in the first hammer mode T1, the rear end projection 153*a* of the slide plate 153 is disengaged from the lever 143*b* of the first operating member 143, so that the first operating member 143 is allowed to be arbitrarily operated by user's finger. Further, in the hammer drill mode HD, the clutch of the power transmitting mechanism 117 is placed in the power transmission state via the clutch switching mechanism 118. Therefore, in the hammer drill mode HD, the user can arbitrarily start and stop the driving motor 111 by operating the first operating member 143 by finger. Thus the user can intermittently (sporadically) perform a hammer drill operation on a workpiece by linear striking movement of the hammer bit 119 and its rotation in its circumferential direction. The hammer drill mode HD is a feature that corresponds to the "second operation mode" according to this invention.

Figure 14:
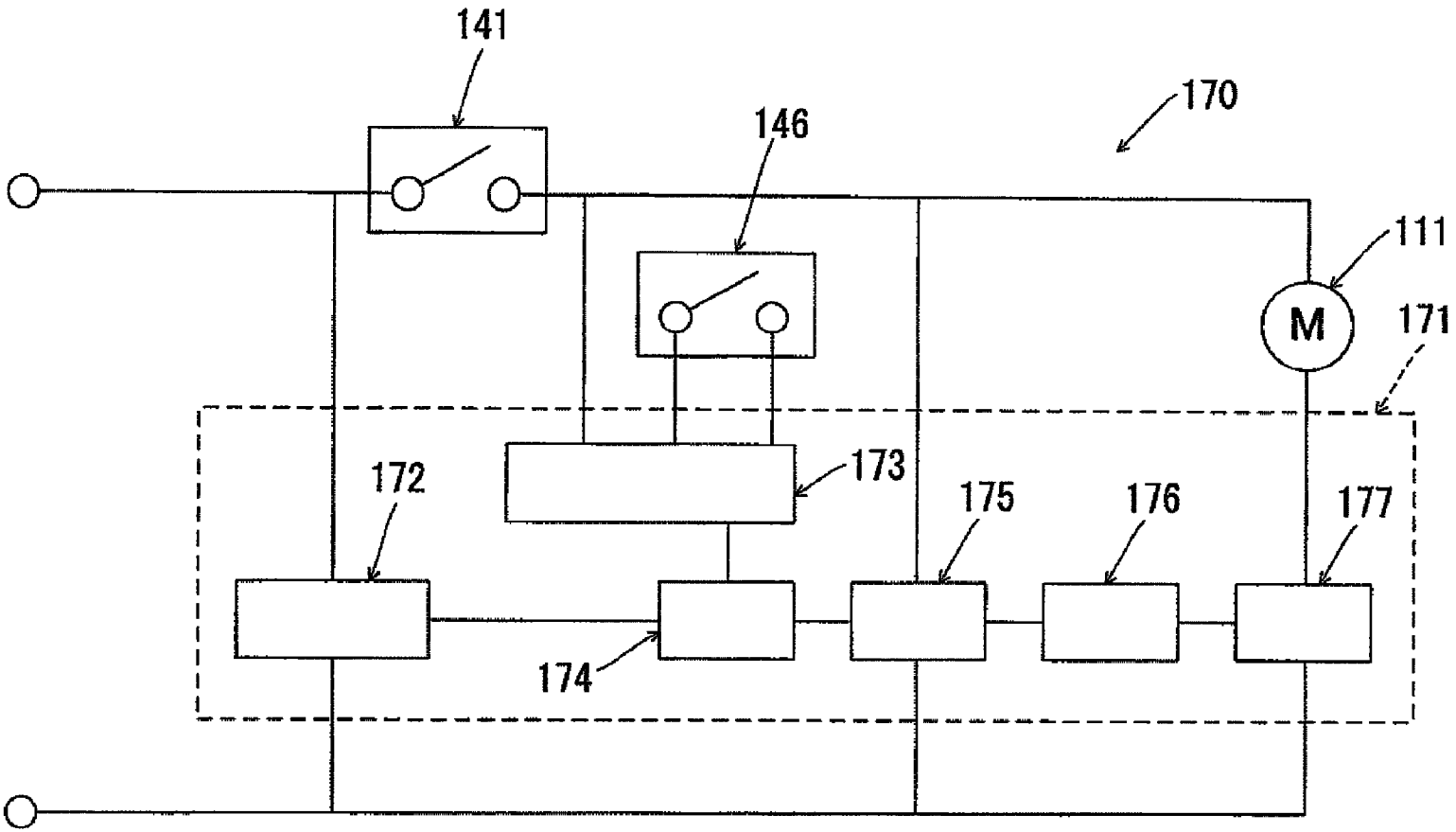
FIG. 14 is a circuit diagram of a control circuit 170 in this embodiment.

Now, a control circuit 170 of the electric hammer drill 101 according to this embodiment is explained with reference to FIG. 14. FIG. 14 is a circuit diagram of the control circuit 170 in this embodiment. The control circuit 170 is formed by a controller 171 as well as the above-described driving motor 111 and first and second switches 141, 146.

The controller 171 is a control device for at least controlling the driving motor 111 and includes a circuit power supply section 172, a switch detecting circuit 173, a computing/driving section 174, a motor control circuit power supply section 175, a motor control section 176, and a drive circuit 177. The controller 171 is a feature that corresponds to the "control device" according to this invention.

The circuit power supply section 172 is designed as a section for supplying external power to the switch detecting circuit 173 and the computing/driving section 174. The switch detecting circuit 173 is designed to detect whether each of the first switch 141 and the second switch 146 is in the on position or in the off position. Specifically, the switch detecting circuit 173 serves to detect the on/off state of the first and second switches 141, 146.

The computing/driving section 174 includes a computing part for computing based on information detected in the switch detecting circuit 173, and a driving part for driving a motor control circuit according to the computation. Particularly, the computing part of the computing/driving section 174 executes at least processing for determining the mode of operation of the hammer bit 119 according to the on/off state of the first and second switches 141, 146 when the power is on. The state in which the "power is on" herein widely includes the on state of the power, and such a state is typically created immediately after the power is turned on. Specifically, the computing/driving section 174 serves to determine the operation mode based on the results of detection of the switch detecting circuit 173. The computing/driving section 174 forms the "operation mode determining section".

The motor control circuit power supply section 175 is designed as a section for supplying external power to the motor control circuit. The motor control section 176 and the drive circuit 177 form a mechanism for controlling drive of the driving motor 111. The motor control section 176 and the drive circuit 177 form the "drive control section".

In the controller 171 having the above-described construction, the computing/driving section 174 determines whether the hammer drill 101 is placed in first operation mode (the above-described second hammer mode T2) or in second operation mode (the above-described first hammer mode T1 or hammer drill mode HD), based on the results of detection of the switch detecting circuit 173. With such a construction, it can be easily determined which one of the operation modes is currently selected. Particularly, by provision of the switch detecting circuit 173 for directly detecting the on/off state of the first and second switches 141, 146, an additional switch to be provided for this purpose can be rationally dispensed with.

Next, the first to fourth determinations on the hammer drill 101 by the computing/driving section 174 are described.

(First Determination)

If the switch detecting circuit 173 detects that the first switch 141 is in the on position and the second switch 146 is in the off position when the power is turned on, it is determined that the hammer drill 101 is placed in the first operation mode (first determination). In the first operation mode, the first switch 141 is locked in the on position, and on-off operation of the second switch 146 is enabled. Based on the first determination, the controller 171 outputs a drive control signal to the driving motor 111 when the second switch 146 is turned from the off position to the on position after determination of the operation mode. Thus the driving motor 111 is started. Further, in this embodiment, as the second switch 146, particularly an electronic switch may be used which energizes and de-energizes the driving motor 111 by electric signals generated upon pressing operation of the second operating member 145. By using such an electronic switch, the energized state of the driving motor 111 can be continued with one click. This electronic switch is designed as a switch which does not have a mechanical contact for passing and interrupting motor current of the driving motor 111. By provision of such an electronic switch, the second switch 146 can be reduced in size and the second operating member 145 can be pressed with a light touch so that ease of operation is enhanced. In the first operation mode, the driving motor 111 is stopped when the second switch 146 is placed in the off position after the driving motor 111 is started.

(Second Determination)

If the switch detecting circuit 173 detects that the first switch 141 is in the off position and the second switch 146 is in the on position when the power is turned on, it is determined that the hammer drill 101 is placed in the second operation mode (second determination). In the second operation mode, the second switch 146 is locked in the on position, and on-off operation of the first switch 141 is enabled. Based on the second determination, the controller 171 outputs a drive control signal to the driving motor 111 when the first switch 141 is turned from the off position to the on position after determination of the operation mode. Thus the driving motor 111 is started.

(Third Determination)

If the switch detecting circuit 173 detects that both the first switch 141 and the second switch 146 are in the on position when the power is turned on, it is determined that the hammer drill 101 is not in normal conditions (third determination). Specifically, in this timing before starting an operation of the hammer drill, the condition in which both of the first and second switches 141, 146 are in the on position means that a switch is left on, for example, due to user's misoperation or dust deposition, or the switch is faulty. Therefore, in the case of the third determination, even if both of the first and second switches 141, 146 are in the on position, the controller 171 disables driving of the driving motor 111.

At this time, preferably, it is controlled to inform the user of the abnormal condition, for example, by using a warning lamp. Further, it is preferable to indicate by illumination which one of the operation modes is currently selected. In this embodiment, a light 167 is provided as the illumination and designed to indicate an abnormal condition when both of the first and second switches 141, 146 are in the on position. The light 167 herein is a feature that corresponds to the "indicating section" according to this invention. With such a construction, the user can easily recognize the on-off state of the second switch 146 by the light 167. The indication by the light 167 can be realized by flashing or illuminating in a single color or multiple colors. The light 167 may be designed as necessary, for example, to indicate that the second switch 146 is in the off state, or to indicate that the second switch 146 is in the on state, or to indicate that the second switch 146 has been switched between the on state and the off state. Thereafter, when either the first switch 141 or the second switch 146 is placed in the on position, the above-described first or second operation mode is entered.

(Fourth Determination)

If the switch detecting circuit 173 detects that both of the first and second switches 141, 146 are in the off position when the power is turned on, it is determined that the hammer drill 101 is placed in the neutral mode between the above-described second hammer mode T2 and hammer drill mode HD (fourth determination). In this neutral mode, driving of the driving motor 111 is disabled. Thereafter, when either the first switch 141 or the second switch 146 is turned from this neutral mode to the on position, the above-described first or second operation mode is entered.

It is essential for the computing/driving section 174 to make a determination based on detection of the switch detecting circuit 173 at least when the power is in the on state. Therefore, the determination may be made when the power is turned on as described above, or it may be made at an appropriate time, for example, after completion of normal operation of the hammer drill.

The electric hammer drill 101 according to this embodiment has the vibration-proof handgrip 109 having the lower end connected to the body 103 such that it can rotate on the pivot 163 in the fore-and-aft direction and having the upper end connected to the body 103 via the vibration-absorbing coil springs 161. Therefore, during hammering or hammer drill operation, transmission of vibration particularly in the axial direction of the hammer bit 119 from the body 103 to the handgrip 109 can be reduced by the coil springs 161.

During operation in the second hammer mode T2, as described above, the first operating member 143 on the handgrip 109 side is forcefully locked in the on position by the slide plate 153 on the body 103 side. Therefore, if the connection between the body 103 and the handgrip 109 is made by a rigid structure, vibration on the body 103 side will be transmitted from the slide plate 153 to the handgrip 109 via the first operating member 143.

Therefore, in this embodiment, the first operating member 143 is formed by the operating member body 143*a* and the lever 143*b* which are connected by the torsion spring 143*c*, so that transmission of vibration from the slide plate 153 to the first operating member 143 is absorbed by utilizing elastic deformation of the torsion spring 143*c* (see FIG. 3). Specifically, according to this embodiment, with such a construction, the vibration-proofing structure of the first operating member 143 is rationally provided on the first operating member 143 side. Thus, the mode selecting function of selecting the operation mode between the second hammer mode T2 in which the first operating member 143 is forcefully locked in the on position and the first hammer mode T1 and hammer drill mode HD in which the first operating member 143 can be arbitrarily operated by the user and the function of proofing vibration of the handgrip 109 by connecting the handgrip 109 to the body 103 via the coil springs 161 can be simultaneously realized.

In this case, in this embodiment, the initial load of the torsion spring 143*c* which is applied to the lever 143*b* upon assembly is designed to be larger than a load which is applied to the built-in off-position biasing spring in the first switch 141 when the operating member body 143*a* is placed in the on position to turn on the switch 141. Therefore, in the second hammer mode T2, the first operating member 143 can be reliably locked in the on position, and the effect of reducing vibration transmission by the torsion spring 143*c* can be obtained.

In any operation mode other than the second hammer mode T2 of continuously performing hammering operation, the forceful lock of the first operating member 143 in the on position by the slide plate 153 is released. Therefore, transmission of vibration from the body 103 to the handgrip 109 can be reduced by the coil springs 161 which connect the handgrip 109 and the body 103. In other words, from another viewpoint, in the electric hammer drill 101 according to this embodiment, the function of reducing vibration of the handgrip 109 is performed by both the coil springs 161 and the torsion spring 143*c* in the second hammer mode T2, while it is performed only by the coil springs 161 in the other operation modes. Specifically, the vibration-proofing spring load of the handgrip 109 in the second hammer mode T2 is different from that in the other operation modes. Therefore, with such a construction, both the operation mode selecting function and the vibration-proof handgrip 109 can be simultaneously realized.

Further, in this embodiment, in the first hammer mode T1 or the hammer drill mode HD, the switch-actuating slide plate 153 for pushing the second operating member 145 to the on position is designed to perform such pushing operation via the linkage 155 which is elastically connected to the slide plate 153 via the coil spring 154. Therefore, the difference between the amount of travel of the second operating member 145 and the amount of travel of the slide plate 153 is accommodated by relative movement of the linkage 155 with respect to the slide plate 153. Thus, the amount of travel of the second operating member 145 and the amount of travel of the slide plate 153 can be arbitrarily and individually set, so that higher freedom of design is obtained.

Further, the first operating member 143 is housed in the internal space 109*b* of the handgrip 109 when it is pushed by the slide plate 153 to the on position. Further, the second operating member 145 is housed in the rear internal space 103*a* within the body 103 when it is pushed by the slide plate 153 to the on position. Therefore, by visually checking whether the first and second operating members 143, 145 are housed or not, the user can distinguish whether the currently-selected mode is the second hammer mode T2 for continuous operation, or the first hammer mode T1 or hammer drill mode HD for intermittent operation. Further, such a structure of housing the operating sections can prevent the biasing force of the spring (biasing means) from acting upon the user via the first operating member 143 or the second operating member 145, so that it is effective in smoothly performing the operation.

The first operating member 143 and the second operating member 145 are opposed to each other, so that they can be operated by the one hand holding the handgrip 109. Further, the rear end region of the body 103 in front of the handgrip 109 is a region remote from the hammer bit 119 and hidden when viewed from the hammer bit 119 side. Therefore, this rear region is not easily affected by dust of the workpiece (concrete) which is generated during hammering or hammer drill operation, so that the dust resistance is enhanced.

Further, in this embodiment, the vibration-absorbing coil springs 161 are disposed on the opposite sides of the axis of the hammer bit 119, and the slide plate 153 is disposed between the coil springs 161. In operation using the electric hammer drill 101, the user holds the handgrip 109 and presses the hammer bit 119 against the workpiece while applying a pressing force to the body 103 in the axial direction of the hammer bit 119. Therefore, by the above-described arrangement of the coil springs 161 on the opposite sides of the axis of the hammer bit 119, stability of the handgrip 109 can be achieved during operation with the hammer bit 119 pressed against the workpiece. Further, by the arrangement of the slide plate 153 between the coil springs 161, a rationally arranged structure can be obtained.

Now, another embodiment of the invention is described with reference to FIGS. 15 and 16. This embodiment is a modification to the vibration proofing spring in the first operating member 143, and the torsion spring 143*c* in the above-described embodiment is changed to a compression coil spring 143*f*. In the other points, it has substantially the same construction as the above-described embodiment. Components which are substantially identical to those in the first embodiment are given like numerals as in the first embodiment and will not be described or briefly described.

Figure 15:
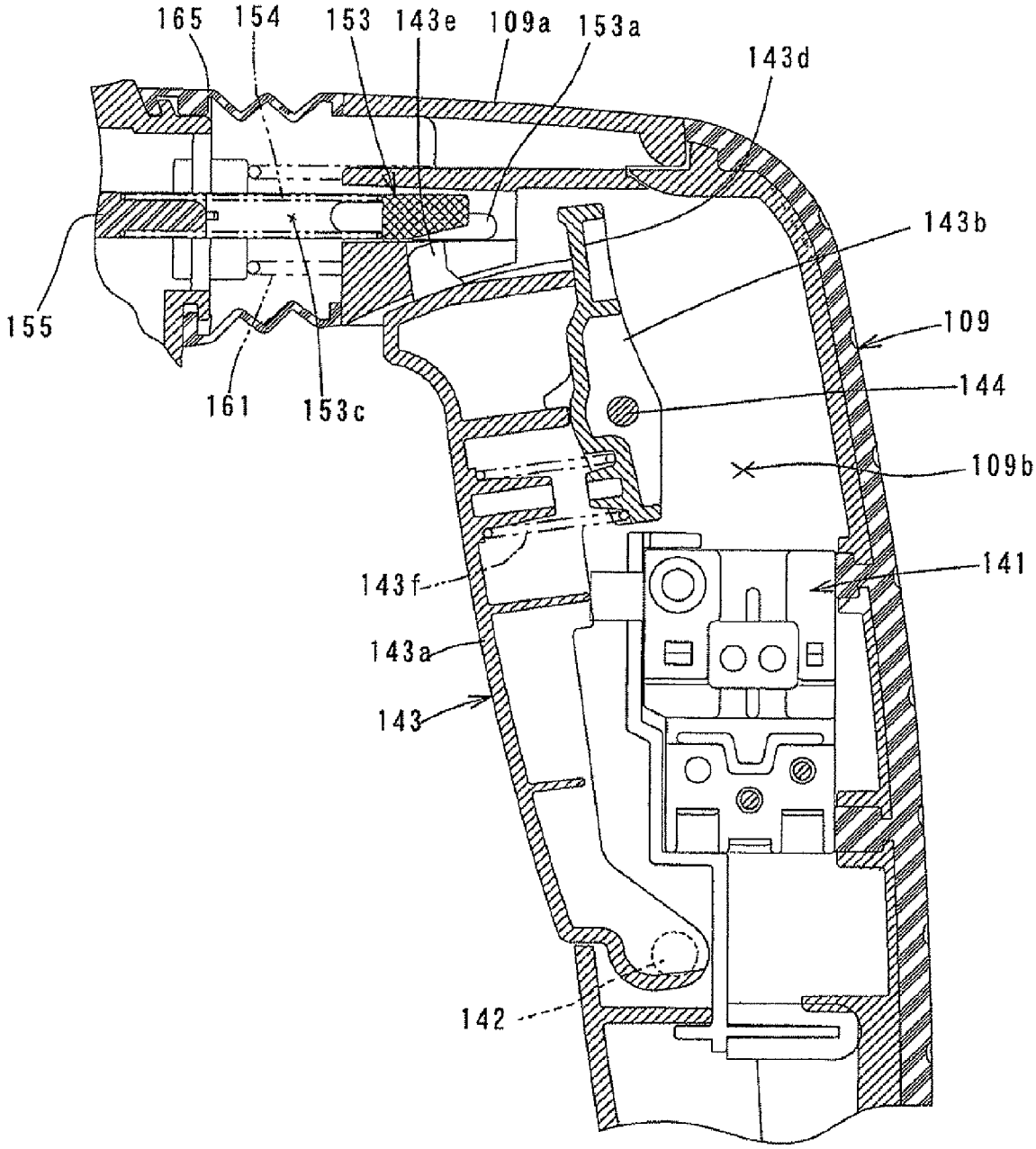
FIG. 15 is a partial view showing the construction of the first operating member according to another embodiment of the invention, in any mode other than second hammer mode.
Figure 16:
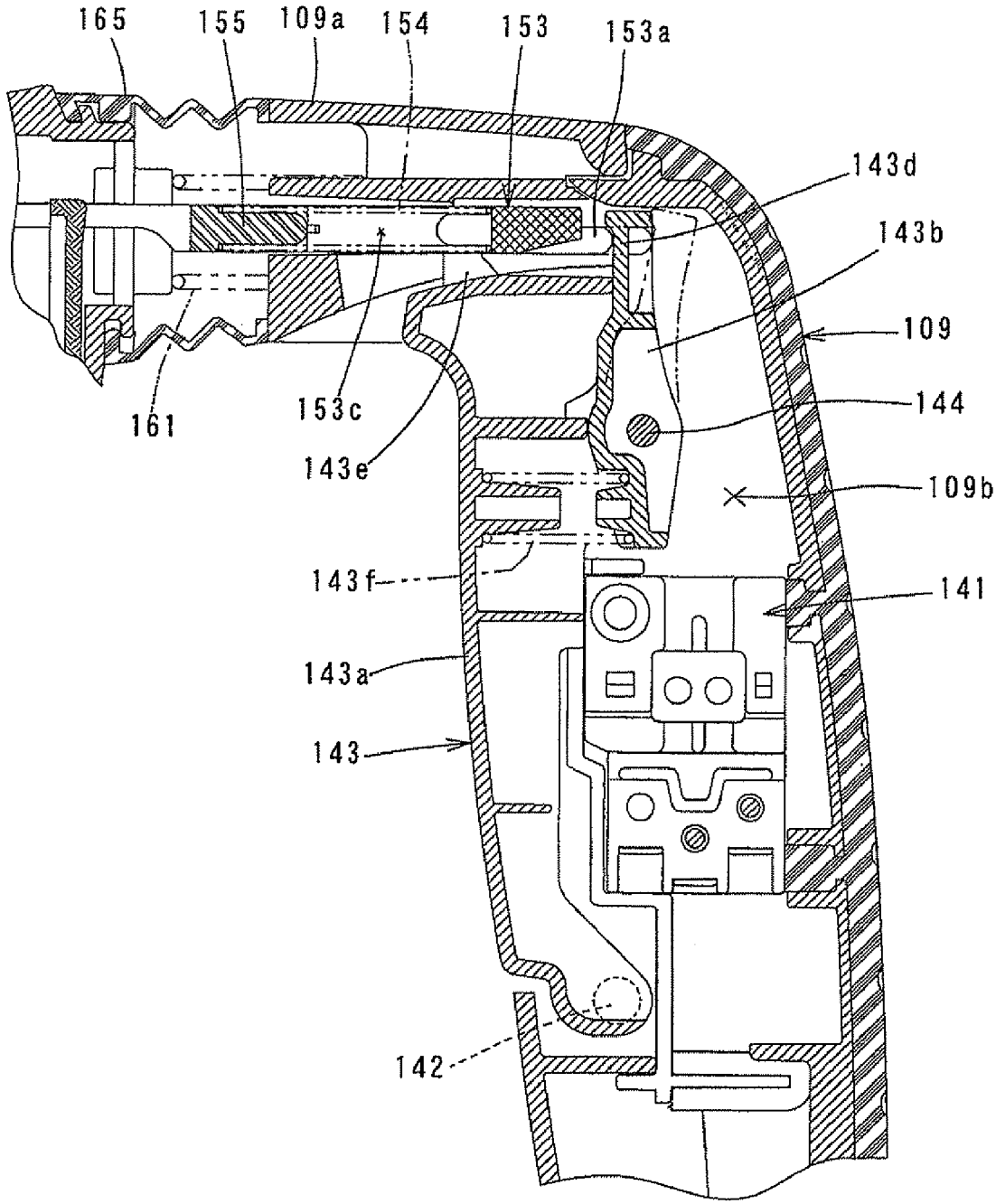
FIG. 16 is also a partial view showing the construction of the first operating member, in second hammer mode.

As shown in FIGS. 15 and 16, the first operating member 143 mainly includes the operating member body 143*a*, the lever 143*b* and the compression coil spring 143*f*. The lever 143*b* is mounted to the operating member body 143*a* such that it can rotate on a fulcrum or pivot (mounting shaft) 144 in the axial direction of the hammer bit 119. The compression coil spring 143*f* is disposed between the front surface of the lower end portion of the lever 143*b* and the rear surface of the operating member body 143*a* and exerts a biasing force to rotate the upper portion of the lever 143*b* forward. The initial load of the compression coil spring 143*f* is similarly set as that of the torsion spring 143*c* of the above-described embodiment. The compression coil spring 143*f* is a feature that corresponds to the "elastic member" and the "compression spring" according to this invention.

Therefore, during operation in the second hammer mode T2 in which the operation mode switching dial 151 is turned to the second hammer mode, when the slide plate 153 moves rearward and the rear end projection 153*a* of the slide plate 153 pushes the lever 143*b* of the first operating member 143 rearward, the first operating member 143 pivots around the mounting shaft 142 to the on position with the lever 143*b* and the operating member body 143*a* held in an integrally connected state by the compression coil spring 143*f* and is forcefully locked in the on position. This state is shown in FIG. 16. In this state, when the hammer bit 119 is pressed against the workpiece, the lever 143*b* is pushed further rearward by the slide plate 153 and pivots around the fulcrum 144 against the compression coil spring 143*f* so that the front surface of the lever 143*b* is disengaged from the rear surface of the operating member body 143*a*. This state is shown by two-dot chain line in FIG. 16. Thus, the first operating member 143 is elastically connected to the slide plate 153 in the state in which it is forcefully locked in the on position by the slide plate 153. Therefore, even if the slide plate 153 vibrates together with the body 103 due to vibration caused in the body 103 during hammering operation, transmission of vibration from the slide plate 153 to the first operating member 143 can be prevented or reduced by the compression coil spring 143*f*.

Further, the invention is not limited to the above-described embodiments, but may be appropriately modified or changed. In the above embodiments, the first operating member 143 is connected to the slide plate 153 via an elastic member in the state in which the first operating member 143 is forcefully locked in the on position by the slide plate 153, and the vibration proofing compression coil spring 143*f* or torsion spring 143*c* is provided on the first operating member 143. As alternatives to this construction, however, an elastic member such as a spring and rubber may be provided between the slide plate 153 and the first operating member 143, or an elastic member may be mounted on the slide plate 153. The structure of mounting an elastic member on the slide plate 153 can be realized, for example, by provision of the construction in which the pushing member of the first operating member 143 is connected to the rear region of the slide plate 153 via the elastic member such that it can move with respect the slide plate 153 in the fore-and-aft direction.

Further, in the present embodiment, in the structure of connecting the eccentric shaft 152 of the operation mode switching dial 151 and the slide plate 153, the engagement slot 159 is arcuately shaped in order to create a difference between the amount of travel of the slide plate 153 and the amount of travel of the component of motion of the eccentric shaft 152 in the fore-and-aft direction. Alternatively, however, the engagement slot 159 may be shaped to extend linearly in a direction transverse to the fore-and-aft direction. Further, it may be designed such that the selection of the operation mode is made not by turning motion but by linear motion. Further, in this embodiment, the operation modes of the hammer bit 119 is described as including the first hammer mode T1, the second hammer mode T2 and the hammer drill mode HD. In addition to these modes, however, it may be constructed to offer a drill mode in which the hammer bit 119 is caused to perform only rotation.

Further, in the present embodiment, the second operating member 145 is designed to automatically return to the off position when it is released after pushed to the on position. It may however be designed to remain in the on position even if it is pushed and then released and to return to the off position when it is pushed again (next time).

Further, in the present embodiment, the electric hammer drill 101 is explained as a representative example of the impact tool, but it can also be applied to a hammer in which the hammer bit 119 is caused to perform only a striking movement.

Having regard to the aspect of the invention, following features can be provided.

"The impact tool as defined in claim 1, wherein the movable member comprises at least two members formed separately in a direction of travel and the two members are connected by an elastic member."

"The impact tool as defined in claim 7, wherein the engagement region comprises an arcuate engagement slot curved toward the tool bit, and the cam face comprises an engagement surface which is engaged with the eccentric shaft when the operation mode switching member is switched from the second operation mode to the first operation mode."

"The impact tool as defined in claim 7, wherein the engagement region has an escape part such that the amount of travel of the movable member toward the tool bit can be made smaller than the amount of travel of the component of motion of the eccentric shaft in the axial direction of the hammer bit when the operation mode switching member is switched from the first operation mode to the second operation mode."

"The impact tool as defined in claim 6, wherein the second manual operating member comprises a lever-like member that extends in a direction transverse to the axial direction of the tool bit and can pivot in the axial direction of the tool bit around a portion of the lever-like member which is remote from the movable member and inserted into a U-shaped receiving member, and in the inserted state, the lever-like member is rotatably supported by the receiving member."

DESCRIPTION OF NUMERALS

101 electric hammer drill (impact tool)
103 body (tool body)
103*a* rear internal space
105 motor housing
107 gear housing
108 rear cover
108*a* opening
109 handgrip
109*a* upper connecting region
109*b* handgrip internal space
111 driving motor
113 motion converting mechanism
115 striking mechanism
117 power transmitting mechanism
118 clutch switching mechanism
119 hammer bit (tool bit)
121 crank shaft
123 crank arm
125 piston
127 cylinder
129 striker
131 impact bolt
133 intermediate gear
135 intermediate shaft
137 first bevel gear
139 second bevel gear
141 first switch
142 mounting shaft
143 first operating member (manual operating member)
143*a* operating member body
143*b* lever
143*c* torsion spring (elastic member)
143*d* upper end portion
143*e* horn-like projection
143*f* compression coil spring (elastic member)
144 fulcrum
145 second operating member (second manual operating member)
145*a* push button
145*b* upper end
145*c* shaft
146 second switch
147 spring
148 screw
149 receiving member
149*a* claw
149*b* U-shaped receiving portion
151 operation mode switching dial (operation mode switching member)
151*a* rotation axis
152 eccentric shaft
153 slide plate
153*a* rear end projection
153*b* slot
153*c* opening
153*d* columnar guide
153*e* rear edge
154 coil spring (second elastic member)
155 linkage
155*a* columnar guide
157 connecting part
159 engagement slot
159*a* rear engagement surface
159*b* front engagement surface
159*c* escape recess
161 vibration-absorbing coil spring (vibration-proofing cushioning material)
163 pivot
165 bellows
167 light
170 control circuit
171 controller
172 circuit power supply section
173 switch detecting circuit
174 computing/driving section
175 motor control circuit power supply section
176 motor control section
177 drive circuit

What we claim is:

1. An impact tool comprising:

a motor, a tool body that houses the motor and has a tip end region to which a tool bit to be driven by the motor is coupled, a handle held by a user and disposed on the tool body at a side opposite to the tip end region to which the tool bit is coupled, a vibration-proofing cushioning material that is disposed between the tool body and the handle and connects the tool body and the handle such that the tool body and the handle can move with respect to each other in an axial direction of the tool bit, a motor-driving manual operating member that is disposed on the handle, biased from an on position to an off position, wherein current is passed to the motor in the on position and the current is interrupted in the off position and wherein the motor-driving manual operating member is normally placed in the off position and can be operated by user's finger between the off position and the on position, an operation mode switching member that is disposed on the tool body and can switch between first operation mode in which the tool bit is continuously driven and second operation mode in which the tool bit is arbitrarily driven, a movable member that is moved in the axial direction of the tool bit by the switching operation of the operation mode switching member, wherein, when the operation mode switching member is switched to the first operation mode, the movable member moves toward the handle and moves the manual operating member from the off position to the on position and locks it in the on position, while, when the operation mode switching member is switched to the second operation mode, the movable member moves away from the handle and releases said lock of the manual operating member so that the manual operating member can be returned to the off position and allowed to be operated by user's finger and a vibration-proofing elastic member that is disposed in a predetermined region in a vibration transmitting path including at least the movable member and the manual operating member, wherein the vibration-proofing elastic member prevents vibration caused in the tool body from being transmitted to the handle via the vibration transmitting path in the state in which the operation mode switching member is switched to the first operation mode and the manual operating member is locked in the on position by the movable member.

2. The impact tool as defined in claim 1, wherein the elastic member is provided as part of the manual operating member.

3. The impact tool as defined in claim 2, wherein the manual operating member comprises an operating member body which can be operated by user's finger, a lever which is mounted to the operating member body in such a manner as to be rotatable with respect to the operating member body in the axial direction of the tool bit, and a compression spring which biases the lever such that the lever can rotate toward the tool bit, and when the operation mode switching member is switched to the first operation mode, in the manual operating member, the lever is pushed toward the handle by the movable member so that the operating member body is moved to the on position via the compression spring and locked in the on position.

4. The impact tool as defined in claim 3 further comprising a biasing member that biases the operating member body toward the off position, wherein a mounting load of the compression spring for biasing the lever such that the lever can rotate toward the tool bit is larger than a load which is applied to the biasing member upon completion of movement of the operating member body into the on position.

5. The impact tool as defined in claim 1, wherein the movable member comprises at least two members formed separately in a direction of travel and the two members are connected by an elastic member.

6. The impact tool as defined in claim 1 further comprising a second manual operating member that starts and stops the motor by moving between the on position and the off position, wherein, when the operation mode switching member is switched to the second operation mode, the second manual operating member is moved from the off position to the on position by the movable member and locked in the on position, while, when the operation mode switching member is switched to the first operation mode, said lock by the movable member is released so that the second manual operating member is allowed to be operated by user's finger.

7. The impact tool as defined in claim 6, wherein a second elastic member which is different from said elastic member elastically connects the second manual operating member and the movable member in the state in which the second manual operating member is locked in the on position by the movable member.

8. The impact tool as defined in claim 7, wherein the second manual operating member comprises a lever-like member that extends in a direction transverse to the axial direction of the tool bit and can pivot in the axial direction of the tool bit around a portion of the lever-like member which is remote from the movable member and inserted into a U-shaped receiving member, and in the inserted state, the lever-like member is rotatably supported by the receiving member.

9. The impact tool as defined in claim 1, wherein the operation mode switching member is designed to be operated by turning around an axis extending in a direction transverse to the axial direction of the tool bit, and the operation mode switching member has an eccentric shaft which is disposed in a position displaced a predetermined distance from said axis and revolves around the axis in engagement with the movable member so as to move the movable member in the axial direction of the tool bit, and in an engagement region of the movable member which is engaged with the eccentric shaft, a cam face is formed in order to create a difference between an amount of travel of the movable member which corresponds to an angle of rotation of the operation mode switching member and an amount of travel of a component of motion of the eccentric shaft in the axial direction of the tool bit when the operation mode switching member is switched to the first operation mode.

10. The impact tool as defined in claim 9, wherein the engagement region comprises an arcuate engagement slot curved toward the tool bit, and the cam face comprises an engagement surface which is engaged with the eccentric shaft when the operation mode switching member is switched from the second operation mode to the first operation mode.

11. The impact tool as defined in claim 9, wherein the engagement region has an escape part such that the amount of travel of the movable member toward the tool bit can be made smaller than the amount of travel of the component of motion of the eccentric shaft in the axial direction of the hammer bit when the operation mode switching member is switched from the first operation mode to the second operation mode.

12. The impact tool as defined in claim 1, wherein the vibration-proofing cushioning materials are disposed on opposite sides of the axis of the tool bit and the movable member is disposed between the cushioning materials.

13. The impact tool as defined in claim 1, wherein a vibration-proofing spring load of the handle differs according to whether the operation mode switching member is switched to the first operation mode or the second operation mode.

14. An impact tool comprising:

a motor, a tool body that houses the motor and has a tip end region to which a tool bit to be driven by the motor is coupled, a handle held by a user and disposed on the tool body at a side opposite to the tip end region to which the tool bit is coupled, a vibration-proofing cushioning material that is disposed between the tool body and the handle and connects the tool body and the handle such that the tool body and the handle can move with respect to each other in an axial direction of the tool bit, a motor-driving manual operating member that is disposed on the handle, biased from an on position to an off position, wherein current is passed to the motor in the on position and the current is interrupted in the off position and wherein the motor-driving manual operating member is normally placed in the off position and can be operated by user's finger between the off position and the on position, an operation mode switching member that is disposed on the tool body and can switch between first operation mode in which the tool bit is continuously driven and second operation mode in which the tool bit is arbitrarily driven and a movable member that is moved in the axial direction of the tool bit by the switching operation of the operation mode switching member, wherein, when the operation mode switching member is switched to the first operation mode, the movable member moves toward the handle and moves the manual operating member from the off position to the on position and locks it in the on position, while, when the operation mode switching member is switched to the second operation mode, the movable member moves away from the handle and releases said lock of the manual operating member so that the manual operating member can be returned to the off position and allowed to be operated by user's finger, wherein a vibration-proofing spring load of the handle differs according to whether the operation mode switching member is switched to the first operation mode or the second operation mode.

* * * * *